US008780133B2

(12) United States Patent
Jeong et al.

(10) Patent No.: US 8,780,133 B2
(45) Date of Patent: Jul. 15, 2014

(54) METHOD OF PROCESSING DATA AND DISPLAY APPARATUS FOR PERFORMING THE METHOD

(75) Inventors: Jae-Won Jeong, Seoul (KR); Jae-Sung Bae, Suwon-si (KR); Bong-Hyun You, Yongin-si (KR); Jai-Hyun Koh, Anyang-si (KR)

(73) Assignee: Samsung Display Co., Ltd. (KR)

( * ) Notice: Subject to any disclaimer, the term of this patent is extended or adjusted under 35 U.S.C. 154(b) by 280 days.

(21) Appl. No.: 12/916,321

(22) Filed: Oct. 29, 2010

(65) Prior Publication Data

US 2011/0148908 A1 Jun. 23, 2011

(30) Foreign Application Priority Data

Dec. 17, 2009 (KR) ..... 10-2009-0125951

(51) Int. Cl.
*G09G 5/02* (2006.01)

(52) U.S. Cl.
USPC ..... 345/590

(58) Field of Classification Search
USPC ..... 345/590–595
See application file for complete search history.

(56) References Cited

U.S. PATENT DOCUMENTS

| | | | | |
|---|---|---|---|---|
| 7,787,702 | B2 * | 8/2010 | Brown et al. | 382/260 |
| 2007/0070086 | A1 * | 3/2007 | Brown et al. | 345/613 |
| 2007/0279372 | A1 * | 12/2007 | Brown et al. | 345/102 |
| 2008/0049048 | A1 * | 2/2008 | Credelle et al. | 345/690 |
| 2008/0117136 | A1 * | 5/2008 | Kim | 345/60 |
| 2009/0058873 | A1 * | 3/2009 | Brown et al. | 345/589 |
| 2009/0102855 | A1 * | 4/2009 | Brown et al. | 345/589 |
| 2011/0043553 | A1 * | 2/2011 | Brown et al. | 345/694 |

* cited by examiner

*Primary Examiner* — Phi Hoang
*Assistant Examiner* — Mohammad H Akhavannik
(74) *Attorney, Agent, or Firm* — Innovation Counsel LLP

(57) ABSTRACT

In a method of processing data of a display apparatus, red, green and blue data are gamut mapped as red, green, blue and white data. The red, green, blue and white data are reconstructed by means of subpixel rendering to generate metameric sets dot pixels composed for example of one such dot pixel having red and green color components and another such dot pixel having blue and white color components such that when the metameric set dot pixels is lit up it produces a white colored region on the display apparatus and when un-lit it appears as contrastingly dark colored region on the display apparatus. By selectively forcing one metameric set of dot pixels to be un-lit, the method allows an immediately adjacent metameric set of dot pixels to be lit-up as a contrasting white region on the display apparatus.

7 Claims, 15 Drawing Sheets

< HORIZONTALLY STRIPED RGB STRUCTURE >

GLYPH = BLACK "A" ON WHITE BACKGROUND

< PENTILE RGBW STRUCTURE >

BRUTE FORCE RENDERED BLACK "A" ON WHITE BACKGROUND

| | | |
|---|---|---|
| 0 | 1 | 0 |
| 1 | 1 | 1 |
| 0 | 1 | 0 |

< 3x3 DATA DETERMINING BLOCK >

METHOD OF PROCESSING DATA AND DISPLAY APPARATUS FOR PERFORMING THE METHOD

PRIORITY STATEMENT

This application claims priority under 35 U.S.C. §119 to Korean Patent Application No. 2009-125951, filed on Dec. 17, 2009 in the Korean Intellectual Property Office (KIPO), the contents of which application are herein incorporated by reference in their entirety.

BACKGROUND

1. Field of Disclosure

The present disclosure of invention relates to a method of processing data and a display apparatus for performing the method. More particularly, the present disclosure relates to a method of processing image data signals for thereby improving expression of a sharp edged glyph such as an alphabetic character and a display apparatus for performing the method.

2. Description of Related Technology

Generally, a flat panel display apparatus may include a matrix of light outputting picture element units (pixel or subpixel units) such as the liquid crystal shuttered units of a liquid crystal display (LCD) panel. The LCD panel is caused to display a desired image using a selective light transmittance characteristic of its liquid crystal material and color filters as well as using a backlight providing assembly disposed underneath to provide light for controlled passage through the LCD panel. A conventional LCD panel has a striped RGB structure. The striped RGB structure includes red, green and blue subpixels, and each of the red, green and blue subpixels is arranged to form a continuous stripe of the subpixel's color in either the column that the respective R, G, B subpixel resides in or in the row of the subpixel's residence. The conventional RGB triad has a capability of providing its own full gamut spectrum of colors as well as a capability of providing a white light when the metameric triad of RGB primary colors are lit up according to an appropriate drive mix (e.g., all turned on to maximum drive).

Recently, so-called Pentile™ RGBW structures have been developed that feature a screen-populating, repeating group having red, green, blue and white subpixels. See for example U.S. 2008/0030526 (Brown Elliott et al.: Methods and Systems for Sub-Pixel Rendering with Adaptive Filtering) which disclosure is incorporated herein by reference. The Pentile™ RGBW structure may be advantageously used to decrease the number of subpixels actually present in the display area of the flat panel while providing an apparent resolution equal to or greater than that of a striped RGB structure having many more subpixels. Since the RGBW repeating group of the Pentile™ structure includes one or more white subpixels and these do not use a light-reducing color filter, an LCD panel having such an RGBW structure tends to have higher light transmittance efficiency when displaying unsaturated colors or black and white images so that luminance of the backlight assembly may be accordingly decreased to thereby reduce power consumption of the display apparatus. For example, for a display apparatus that is used in an office environment where black on white background typing is desired, black characters may be displayed on a white board background where the white board background is produced at least partly by the white subpixels, so that power consumption may be remarkably reduced relative to a display using only the striped RGB structure (and having corresponding R, G and B; light suppressing color filters). However, due to the discrete nature in which the RGBW subpixels are spatially arranged, the display apparatus having the RGBW structure may not display the character (or another glyph having slanted sharp edges, etc.) as an image that is perceived to be a smoothly formed one.

FIGS. 1A and 1B are respective conceptual diagrams showing how an alphabetic character "A" might be respectively displayed as a black filled glyph on a first display panel having the conventional striped RGB structure and on a second display panel having an RGBW structure (in this case an 8-cell RGBW repeating group).

Referring to FIGS. 1A and 1B, while the attempted display of the character "A" on the first display panel (RGB structured) is smoothly displayed, the attempted display of the same character "A" on the second display panel (RGBW structured) can appear distorted when the white board generating algorithm tries to make maximal use of the white subpixels and color balancing and the character "A" is therefore not always smoothly displayed on the display panel having the RGBW structure. More specifically, and comparing it to the idealized "A" shown in FIG. 1A, the RGBW formed "A" of FIG. 1B suffers from drawbacks such as that, some regions of the "A" character which should not be displayed as black are displayed as black, and some regions of the "A" character which should be displayed as black instead displayed as white. Yet more specifically, consider the interior white area of the capitol "A" glyph immediately below the apex of the "A". In FIG. 1A this interior white area is displayed as two RGB triads lit up in a column and surrounded by black. However, in FIG. 1B this interior white area consists of one horizontal RGB triad in one row and just one lit-up W subpixel in the row below. Color balancing for providing a fully white color is thus preserved. However the shape of the intended "A" glyph is not preserved. Accordingly, the characters are not always smoothly displayed as originally intended on the display panel having the RGBW structures.

DEFINITIONS

Traditionally, terms such as "pixel" and "subpixel" have provided sufficient means for expressing the functions of basic picture elements in a conventional stripe RGB display structure. However, with the advent of newer types of picture element structures it sometimes becomes desirable to be able to express other concepts. The term "metameric" as used herein refers to a plurality of adjacent light emitting units that are individually drivable to output corresponding luminosities in respective wavelength bands including at least one combination that can appear as white light to the human visual system. Adjacent red and cyan light emitting elements, for example, can define a metameric pair. Adjacent blue and yellow light emitting elements can also define a metameric pair. Adjacent RGB light emitting elements can define a metameric triad. Because the human visual system has been shown to perceive spatial resolution differently if tested with only adjacent black and white light emitting elements as compared to adjacent colored elements (where black/white resolution tends to be finer than color versus adjacent color resolution), it is sometimes desirable to speak in terms of picture elements that affect black/white resolution. The term "dot pixel" will be used herein. More specifically, reference will be made herein to a blueish-white "dot pixel" (also denoted as: BW Dp) that is capable of outputting adjacent lights that appear to be blueish-white to the human visual system and reference will be made herein to a yellowish-white "dot pixel" (also denoted as: YW Dp) that is capable of outputting adjacent lights that appear to be yellowish-white (or even just simply yellow) to the human visual system. The yellowish-white "dot pixel" (YW Dp) will also be referenced herein at times as a Red-Green dot pixel (also denoted as: RG Dp). The non-white colors, blueish-white and yellowish-white, will be referenced herein at times as off-white colors. An immediately adjacent combination of different off-white dot pixels, namely, a blueish-white "dot pixel" and a yellowish-white "dot pixel" (B+W Dp and Y+W Dp) may be capable of outputting adjacent lights that appear to be white-white (or more simply, white) to the human visual system. Thus, one can have a metameric pair of adjacent off-white dot pixels (a BW Dp adjacent to a YW Dp). Reasons for such additional definitions will become clearer from the below detailed descriptions.

SUMMARY

The present disclosure of invention provides a method of processing image data signals for thereby improving expression of sharp edged glyphs (e.g., alphabetic characters) when the latter are displayed on a display panel having an RGBW repeating group structure.

The present disclosure of invention also provides a display apparatus for performing the above-mentioned method.

According to one aspect of the present disclosure, there is provided a machine-implemented and automated method of processing the image data signals of a display apparatus so as to reduce or eliminate the aforementioned problem. In the method, supplied red, green and blue input data signals are re-mapped into a gamut space having red, green, blue and white data components as its primary light providing elements. The gamut-mapped red, green, blue and white data are rendered by way of area resampling onto coverage areas of respective dot pixels, where in one embodiment, the dot pixels include blueish-white dot pixels (BW DP's) immediately adjacent to yellowish-white dot pixels (YW DP's; where the latter are also at times referred to herein as RG Dp's). When a clean black line is to be rendered by the display, where the line is vertical or horizontal, a selective algorithm automatically sets to a predetermined black grayscale level an immediately adjacent first pair consisting of a BW Dp and a YW Dp so that corresponding other adjacent pairs of the BW Dp's and YW Dp's neighboring the first pair may be lit-up as white light outputting pairs in sharp contrast to the blackened first pair of metameric off-white dot pixels. In one embodiment, the decision to selectively force adjacent pairs of the BW Dp's and YW Dp's to be the predetermined black grayscale level is automatically made based on the input red, green and blue data signals. In one embodiment, the algorithm bypasses the forced blackening of the first pair of metameric dot pixels (Dp's) when they are automatically detected to be part of a predetermined checkerboard pattern.

According to another aspect of the present disclosure, there is provided a method of processing data of a display apparatus. In the method, red, green and blue data are gamut mapped as red, green, blue and white data. The red, green, blue and white data are area resampled to align with BW Dp's and YW Dp's of the display apparatus. The display apparatus includes a blue shifting module and a subpixel rendering module.

According to still another aspect of the present disclosure, a display apparatus includes a display panel, a light source part and a data processing circuit. The display panel includes a first dot pixel having red and green subpixels and a second dot pixel having blue and white subpixels. The dot pixels are selectively activated to display different kinds of image including images with horizontal and/or vertical black lines. The light source part provides backlighting light to the display panel. The data processing circuit automatically forces the first and second kinds of dot pixels (BW Dp's and YW Dp's) to a predetermined black grayscale level based on input red, green and blue data. The data processing circuit includes a gamut mapping part and a subpixel rendering part. The gamut mapping part maps the red, green and blue data as red, green, blue and white data. The subpixel rendering part uses area resampling to reconstruct the gamut mapped data to align with coverage areas of the first and second kinds of dot pixels (BW Dp's and YW Dp's) of the display apparatus.

According to still another aspect of the present disclosure, a display apparatus includes a display panel, a light source part and a data processing circuit. The display panel includes a dot pixel having red and green subpixels or blue and white subpixels. The dot pixel displays an image. The light source part provides light to the display panel. The data processing circuit includes a gamut mapping part and a subpixel rendering part. The gamut mapping part maps red, green and blue data as red, green, blue and white data. The subpixel rendering part selectively applies a blue shift algorithm processing a color change between adjacent data smoothly to the red, green, blue and white data. The subpixel rendering part reconstructs the red, green, blue and white data to generate red and green data or blue and white data using the adjacent data adjacent to the red, green, blue and white data.

According to a method of automatically processing data and a display apparatus for performing the method, input red, green and blue data having a grayscale that is within a predetermined threshold of a predetermined black grayscale and are corresponding to a sharp edged glyph such as an alphabetic character are automatically found and their corresponding dot pixels (BW Dp's and YW Dp's) of the display apparatus are selectively forced to have the predetermined black grayscale if they are not part of a predetermined checkerbox pattern.

In addition, when the red, green, blue and white data are in a region where the character is displayed, a blue shift algorithm may be selectively bypassed so as to improve the expression of the character.

BRIEF DESCRIPTION OF THE DRAWINGS

The above and other features and advantages of the present disclosure will become more apparent by describing in detailed example embodiments with reference to the accompanying drawings, in which.

DETAILED DESCRIPTION

Figure 1A:
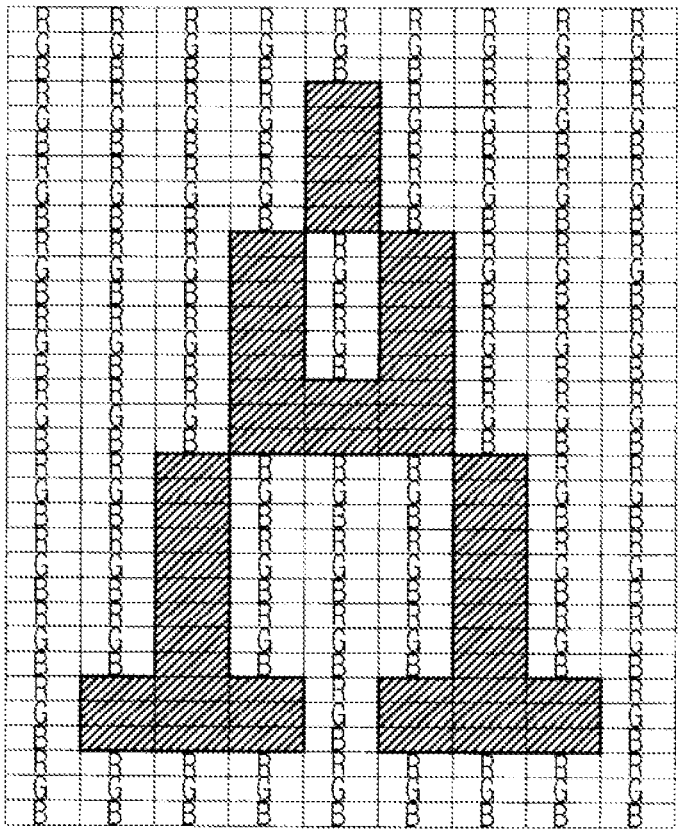
FIGS. 1A and 1B are conceptual diagrams respectively illustrating a character "A" displayed on a display panel having a conventional RGB structure and an RGBW structure.

The present disclosure is provided more fully hereinafter with reference to the accompanying drawings, in which example embodiments are shown. The present teachings may, however, be embodied in many different forms and should not be construed as limited to the example embodiments set forth herein. Rather, these example embodiments are provided so that this disclosure will be thorough and complete, and will fully convey the scope of the present teachings to those skilled in the pertinent art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized example embodiments (and intermediate structures) of the present teachings. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present teachings.

Unless otherwise defined, all terms (including technical and scientific terms) used herein have the same meaning as commonly understood by one of ordinary skill in the art to which this disclosure most closely pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present teachings will be provided in more detail with reference to the accompanying drawings.

Figure 2:
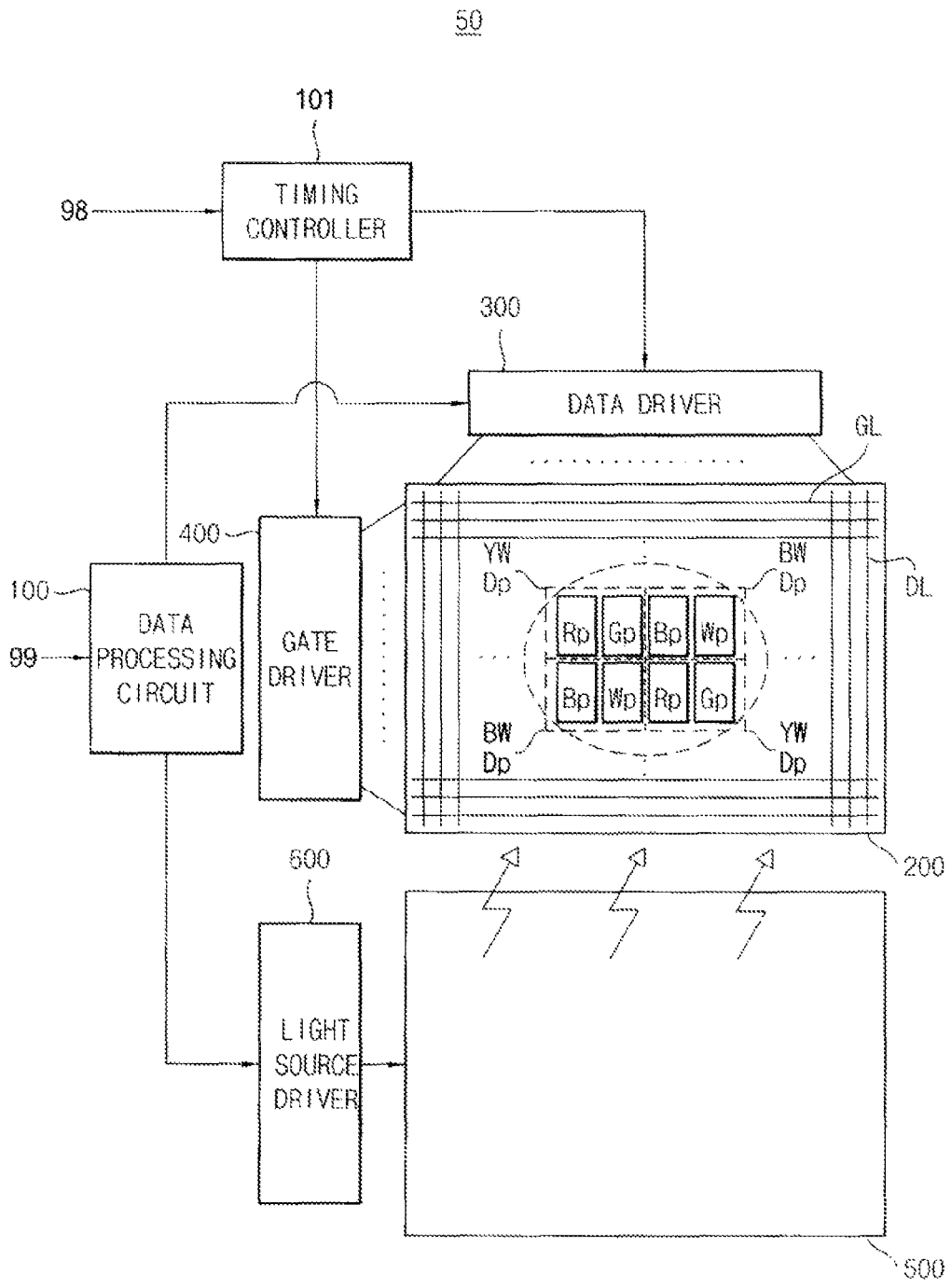
FIG. 2 is a plan view illustrating a display apparatus according to an example embodiment in accordance with the disclosure.

FIG. 2 is a plan schematic view illustrating a display apparatus according to a first example embodiment 50.

Referring to FIG. 2, the display apparatus 50 according to the present example embodiment includes a timing controller 101, a data processing circuit 100, a display panel 200, a data lines driver 300, a gate lines driver 400, a backlighting light source part 500 and a light source driver circuit 600.

The timing controller 101 controls driving timings of the data lines driver 300 and of the gate lines driver 400 based on one or more synchronization signals received from outside (from the left in FIG. 2).

The data processing circuit 100 receives conventional striped RGB data from outside (from the left in FIG. 2) and responsively generates image rendering red, green, blue and white data signals: Rro, Gro, Bro and Wro (see FIG. 3) based on the red, green and blue data signals R, G and B received from the outside. In the illustrated example the RGBW repeating group has an 8-cell structure shown at the center of the display area of substrate 200 and by way of further example, the data processing circuit 100 may generate red and green subpixel driving signals (e.g., Rro and Gro) corresponding to differently located ones of the red subpixels and the green subpixels, Rp and Gp provided in the illustrated 8-cell RGBW repeating group. However if a not fully saturated color is to be produced, the data processing circuit 100 may additionally generate blue and white subpixel driving signals (e.g., Bro and Wro) corresponding to differently located ones of the blue and white subpixels, Bp and Wp, provided in the illustrated 8-cell RGBW repeating group based on how much of a white light component is present the originally supplied, RGB signal. In addition, in some embodiments (so-called, dynamically backlit LCD panels) the data processing circuit 100 may further generate one or more luminance control signals for controlling a corresponding one or more luminance levels output from respective parts of the light source part 500 based on how much of a white light component is present the originally supplied, RGB signal.

As mentioned, the display panel 200 has an RGBW structure including red, green, blue and white subpixels Rp, Gp, Bp and Wp (two independently drivable instances of each in the example of FIG. 2). The illustrated 8-cell RGBW repeating group may be viewed as comprising a diagonally opposed pair of blueish-white dot pixels (BW Dp's) and a diagonally opposed pair of yellowish-white dot pixels (YW Dp's). As mentioned above, a combination of a BW Dp and an adjacent YW Dp may be activated to appear to provide white-white output light (BW+YW=WW) in that screen location. The illustrated display panel 200 includes a plurality of data lines DL, a plurality of gate lines GL crossing with the data lines DL. The display area of panel 200 is substantially tessellated with copies of the 8-cell repeating group, which repeating group is filled with four, adjacent "dot pixels", Dp's, where each such dot pixel consists of two yellow-producing capable or blue-white producing capable subpixels. In other words, each of the dot pixels Dp contains either a pair of red and green subpixels, Rp and Gp, or a pair of blue and white subpixels, Bp and Wp. In the illustrated example, a size (area) of a dot pixel Dp(RG) or Dp(BW) respectively including red and green subpixels Rp and Gp or blue and white subpixels Bp and Wp is roughly the same as that of a conventional RGB metameric "pixel" that consists of adjacent red, green and blue subpixels in a comparable RGB striped structure.

The data driver 300 converts the red, green, blue and white digital data signals Rro, Gro, Bro and Wro into red, green, blue and white data voltages, and provides the red, green, blue and white data voltages to the data lines DL of the substrate 200.

The gate driver 400 sequentially provides row-activating gate signals such as in one at a time sequence to the gate lines GL.

The light source part 500 includes a light source generating light. The light source part 500 provides the light to the display panel 200. The light source may include one or more fluorescent lamps or one or more different kinds of light emitting diodes (LEDs) in edge lighting or backlighting configuration.

The light source driver 600 controls driving of the light source part 500. The light source driver 600 may control luminance of the light provided to the display panel 200 based on the luminance control signal outputted from the data processing circuit 100.

Figure 3:
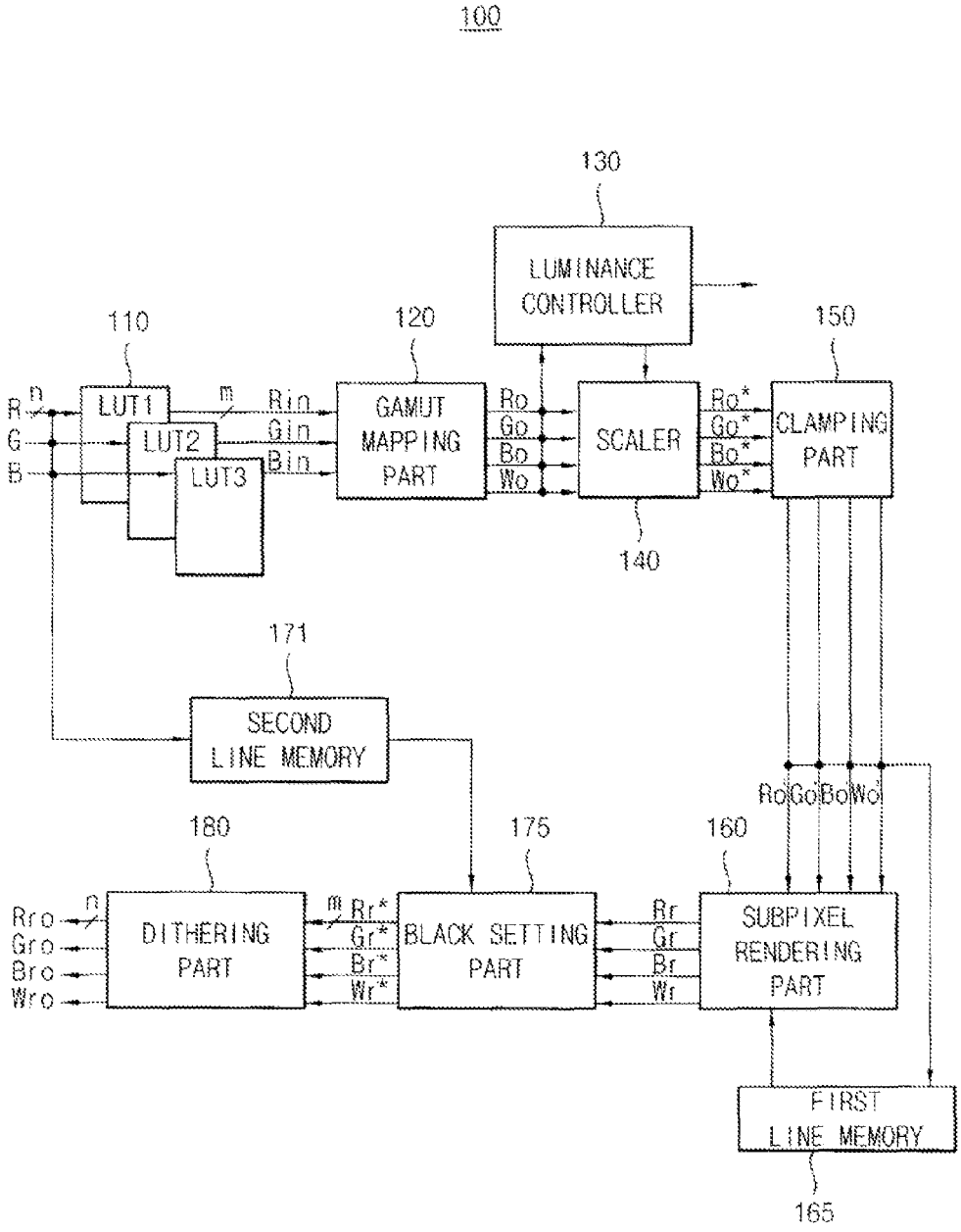
FIG. 3 is a block diagram illustrating a data processing circuit of FIG. 2.

FIG. 3 is a block diagram illustrating details of one embodiment of the data processing circuit 100 of FIG. 2.

Referring to FIGS. 2 and 3, the data processing circuit 100 includes an input gamma function transformer (or generator) 110, a gamut mapping part 120, a luminance controller 130, a scaler 140, a clamping part 150, a subpixel rendering part 160, a first line memory buffer 165, a second line memory buffer 171, a black setting part 175 and a dithering part 180.

As is known to those skilled in the art, conventional RGB input data is provided as not-linearly distributed value encodings (encoded brightness signals). In order to transform these into linearly distributed value encodings (luminance encodings); a so-called input gamma function transform is generally performed. The input gamma generator 110 of the illustrated embodiment includes a red transform lookup table LUT1, a green transform lookup table LUT2 and a blue transform lookup table LUT3. The input gamma generator 110 outputs m-bit wide, linearized red data Rin, m-bit wide, linearized green data Gin and m-bit wide, linearized blue data Bin based on the supplied n-bit wide, nonlinearized red data R, n-bit wide, nonlinearized green data G and n-bit wide, nonlinearized blue data B using the red, green and blue lookup tables LUT1, LUT2 and LUT3. The n and m are natural numbers and n<m. For example, n may be 8-bits wide and m may be 12-bits wide.

The gamut mapping part 120 maps the m-bit wide, linearized red, green and blue data signals Rin, Gin and Bin into an alternate gamut space defined by corresponding m-bit wide, and still linearized red, green, blue and white data Ro, Go, Bo and Wo (where it is to be noted here that Wo is an added color component corresponding to the less conventional RGBW structure).

The gamut mapping part 120 receives the red, green and blue data signals Rin, Gin and Bin. The red, green and blue data signals Rin, Gin and Bin may be paired to represent dot data pairs corresponding to respective dot pixels (Dp's). The gamut mapping part 120 generates the red, green, blue and white data Ro, Go, Bo and Wo based on the red, green and blue data Rin, Gin and Bin.

In one embodiment, the gamut mapping part 120 calculates and generates as an internal signal, a white ratio signal WR according to exemplary Equation 1 as follows.

$$\text{White Ratio}(WR) = \frac{L_W}{L_R + L_G + L_B} = m_2 \qquad \text{[Equation 1]}$$

Here, $L_R$ is the output red luminance level, $L_G$ is the green luminance level, $L_B$ is the blue luminance level and $L_W$ is the output white luminance level.

The gamut mapping part 120 may generates the red, green, blue and white data Ro, Go, Bo and Wo based on a white ratio value WR ($=m_2$) that satisfies below Equation 2.

[Equation 2]

$$2Ro = Rin(1 + m_2) - 2m_2 Wo$$

$$2Go = Gin(1 + m_2) - 2m_2 Wo$$

$$2Bo = Bin(1 + m_2) - 2m_2 Wo$$

$$2m_2 Wo = \frac{(2Rin + 5Gin + Bin)}{8},$$

$$\max(Rin, Gin, Bin)(1 + m_2) - 1 \le 2m_2 Wo \le \min(Rin, Gin, Bin)(1 + m_2)$$

The luminance controller 130 then responsively determines a luminance level to be provided by the light source part 500 using a histogram based on the red, green, blue and white data Ro, Go, Bo and Wo generated by the gamut mapping part 120. Compared to a conventional display panel having just the striped RGB structure, the display panel 200 according to the present example embodiment further includes the white subpixel so that the display panel 200 has a higher white light emission efficiency. Thus, the light source part 500 may be driven at a relatively lower luminance level, and power consumption of the display apparatus may be comparatively decreased.

The scaler 140 redetermines grayscale levels of the red, green, blue and white data Ro, Go, Bo and Wo generated in the gamut mapping part 120 based on the luminance level(s) determined as the output(s) for the luminance control part 130. In other words, the actual luminance output of each pixel unit is the combination of the intensity of backlighting provided for that pixel unit and the percentage of light that will be passed through the liquid crystal layer based on how the liquid crystal cell is driven. The scaler 140 determines the new liquid crystal cell drive amount based on the setting of the backlighting amount.

Sometimes the scaler produces drive results (Ro*, Go*, Bo*, Wo*) that exceed the drive capabilities of the LCD panel either on the low luminance end or the high illustrated end of the capabilities spectrum. The clamping part 150 responsively compensates the red, green, blue and white data Ro*, Go*, Bo* and Wo* determined in the scaler 140 so that, for example, pure saturated color output is slightly sacrificed and some white component is added in that location when the light source part 500 is being driven with a very low luminance level and the desired level of saturated-only color cannot therefore be produced in that screen location.

The first line memory buffer 165 stores the post-clamping data (Ro', Go', Bo', Wo') outputted from the clamping part 150 on a display line-by-line basis so that a previous line is stored in the first line memory buffer 165 when data for a next subsequent display line arrives through the pipeline. For example, the first line memory buffer 165 may store adjacent data adjacent to the red, green, blue and white data Ro', Go', Bo' and Wo' so that a next described, subpixel rendering part 160 can use both previous line luminance values and current line luminance values to re-render the display drive signals on a subpixel rendering basis (e.g., area resampling and luminance redistribution based on the area resampling as well as optional color rebalancing and luminance channel filtering).

The subpixel rendering part 160 reconstructs the red, green, blue and white data Ro', Go', Bo' and Wo' to thereby generate rendered red and green data Rr and Gr or blue and white data Br and Wr using the adjacent data adjacent to the red, green, blue and white data Ro, Go, Bo and Wo stored in the first line memory buffer 165 according to a pixel structure of the display panel 200.

The second line memory buffer 171 stores yet further history about the red, green and blue data R, G and B which are input as data into the LUTs 110.

The black setting part 175 (also referenced herein as the black re-establishing part 175) determines whether the pre-gamma converted, brightness levels specified by the red, green and blue data R, G and B stored in the second line memory buffer 171 include brightness levels corresponding to a predefined black grayscale level. If the red, green and blue data R, G and B do not include the predefined black grayscale level, then the black re-establishing part 175 outputs the red and green data Rr* and Gr* or the blue and white data Br* and Wr* outputted from the subpixel rendering part 160 as they are, without any alteration.

On the other hand, if the red, green and blue brightness data R, G and B retained by the second line memory buffer 171 indicate that a full black luminance was originally intended, the black re-establishing part 175 further analyzes the data to automatically determine whether the red, green and blue brightness data R, G and B define a black dot pattern corresponding to a predetermined dot-check pattern, where this is done using adjacent data adjacent the red, green and blue data R, G and B which are stored in the second line memory buffer 171.

If the red, green and blue data R, G and B do not include the black dot configuration according to the predetermined dot-check pattern, the black setting part 175 sets the grayscale level of the red and green data Rr and Gr or the blue and white data Br and Wr outputted from the subpixel rendering part 160 as the predetermined black grayscale level. On the other hand, if the red, green and blue data R, G and B include the black dot data having the predetermined dot-check pattern, the black setting part 175 outputs the red and green data Rr* and Gr* or the blue and white data Br* and Wr* outputted from the subpixel rendering part 160 as they are, without any alteration; in other words, without over-writing and thus re-establishing the original full black level.

The dithering part 180 is optimal and it may perform temporal and/or spatial gray-scale dithering for the red and green data Rr and Gr or the blue and white data Br and Wr which are processed to m-bit type. The dithering part 180 outputs n-bit red and green data Rro and Gro or n-bit blue and white data Bro and Wro, where n is less than m. Stated otherwise; if the output RGBWr* from the black re-establishing part 175 calls for a higher degree of gray scale precision per subpixel than the LCD panel can deliver in a single instant; say 12-bits of gray scale resolution per subpixel (m=12) where the LCD panel can only deliver, say, 8-bits of gray scale resolution per subpixel in a single instant (n=8), then one or both of temporal and spatial gray-scale dithering are provided by the dithering part 180 such that the average human visual system perceives the desired higher gray scale resolution on per subpixel or per dot pixel basis.

Figure 4A:
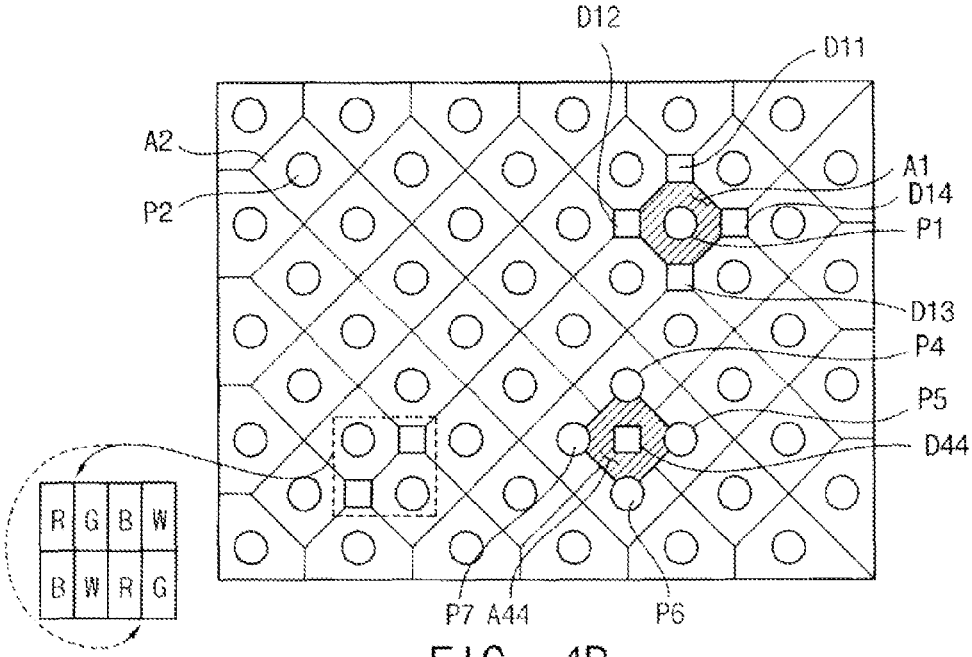
FIGS. 4A and 4B are conceptual diagrams illustrating operation of a subpixel rendering part of FIG. 3.
Figure 4B:
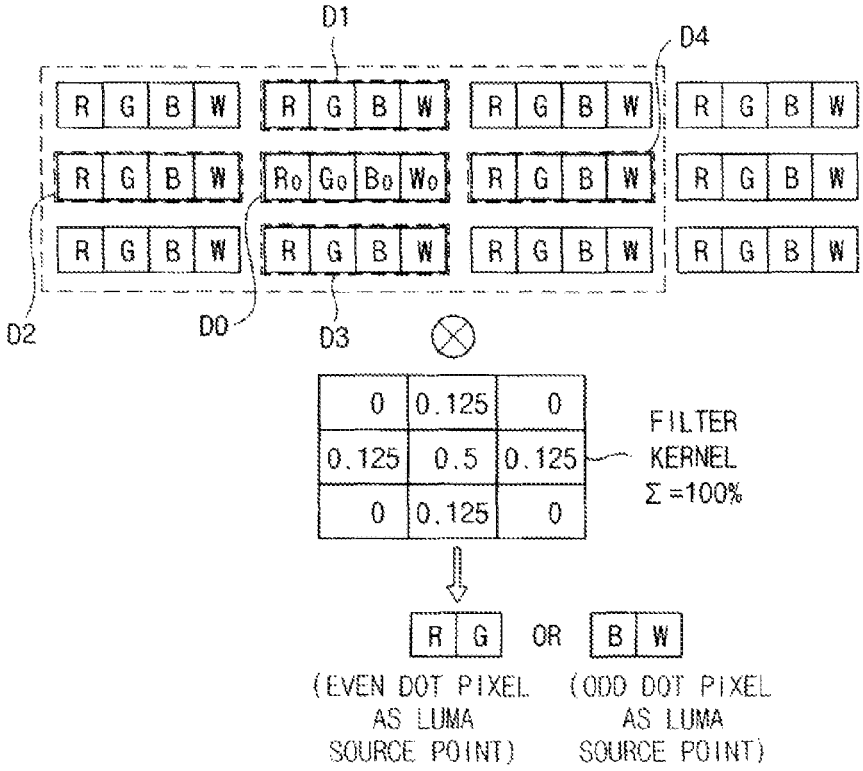

FIGS. 4A and 4B are conceptual diagrams providing an example of how area resampling may be carried out by the subpixel rendering part of FIG. 3.

In FIG. 4A, each circle (e.g., P1, P2, etc.) represents a light-outputting point light source and the usually diamond shaped area (e.g., A1) surrounding that point light source (e.g., P1) represents a coverage area assigned to that point light source. As can be seen in FIG. 4A, the point light sources (circles P1, P2, etc.) are regularly distributed and their correspondingly assigned coverage areas (generally diamond shaped areas) are defined by virtual lines drawn equidistant between the regularly spaced apart point light sources (circles P1, P2, etc.).

Also in FIG. 4A, each non-diamond square (e.g., D11, D12) represents an input or source-data dot pixel. That is, for each RGBW set output by the gamut mapping part 120 of FIG. 3, there is a corresponding source-data dot pixel location represented by one of the non-diamond squares (e.g., D11, D12) shown in FIG. 4A. Not all the source-data dot pixel locations are shown. This is done to avoid illustrative clutter. Some of the source-data dot pixels (e.g., D11, D12, D13, D14) are overlaid on the map of the display screen point light sources (e.g., circle P1) such that these source-data dot pixels (e.g., D11, D12, D13, D14) are shared by multiple diamond shaped areas (e.g., A1) of corresponding, on display, point light sources (circles). More specifically, each of source-data dot pixels D11, D12, D13, and D14 must distribute its intended luminance contribution four ways, namely, to the diamond areas on its left and right and to the diamond areas above and below it. What is not shown in FIG. 4A, but will be shown in FIG. 4B is that a source-data dot pixel (e.g., D0 of FIG. 4B) can come to be overlaid in the center of a diamond shaped areas (e.g., A1); in which case, that source-data dot pixel (e.g., D0) does not spread its intended luminance contribution elsewhere, but rather contributes its luminance value only to the point light source (e.g., P1) that owns that diamond shaped area (e.g., A1). In a case where a plurality of source-data dot pixels (e.g., D0, D11, D12, D13, D14) come to be overlaid both inside and across the boundaries of a given diamond shaped areas (e.g., A1), the intended luminance contributions of each are normalized (in one embodiment) so that the sum of contribution percentages is 100%. This is accomplished for example in the luminance contribution kernel filter of FIG. 4B by assigning 50% weight to the fully-inside-the-area source-data dot pixel (D0) and by assigning 12.5% weight to the one-quarter inside-the-area source-data dot pixels (D1, D2, D3, D4).

Referring to further details of FIG. 4A, a circular point P1 represents the display screen construct that is intended to generate a corresponding one of red, green, blue or white point source output based on the contribution of surrounding source-data dot pixels (e.g., D11, D12, D13, D14) disposed adjacent to the circular point P1. As mentioned, the usually diamond shaped area (e.g., A1) assigned to the circular point P1 represents the coverage area of that circular point P1.

FIG. 4A also shows an alternate way of looking at how much contribution each source-data dot pixel (e.g., D44) is intended to make to the circular points (e.g., P4, P5, P6 and P7) over whose domains the given source-data dot pixel (e.g., D44) is overlaid. A diamond shaped area A44 is assigned to corresponding source-data dot pixel D44 and the percentage of overlay of that area A44 over the coverage areas (e.g., A1) of the circular points (e.g., P4, P5, P6 and P7) is computed. This alternate way of viewing the situation is more general in that the way that a geometrically scaled pattern of source-data dot pixels can overlay a predetermined pattern of on-screen, point light sources (e.g., P1) can vary depending on the actual design of the subpixel repeating groups of the display. In FIG. 4A, each Red subpixel in the 8-cell Pentile repeating group may map to a corresponding on-screen, point light source (e.g., P1). Alternatively or additionally, each lumina dot pixel (Dp) such as each RG dot pixel may map to a corresponding on-screen, point light source (e.g., P1). Similarly, by shifting the illustrated dashed square one step left or right, it can be seen that each BW dot pixel may map to a corresponding on-screen, point light source (circle). It should be apparent that each BW dot pixel may be used to serve as a blueish-white light outputting point. While not as clearly apparent, each RG dot pixel may be used (in combination with a Blue subpixel lent from an adjacent dot) to serve as a white light outputting point (BW+YW=WW).

Referring to the specifics of FIG. 4B, shown there is an example of a luminance channel filtering kernel that may be used as part of a subpixel rendering algorithm to remap input definitions of white light source areas (e.g., A44) into corresponding luminance outputs to be provided by the on-screen, point light source (circles). In FIG. 4B, the non-Pentile RGBW structure denoted as D0 (and which consists of the red, green, blue and white data components identified as Ro, Go, Bo and Wo) is deemed to be at a center of a nine pixel area that happens to overlay the coverage area of a Pentile dot pixel (either an RG dot pixel or a BW dot pixel). In accordance with area resampling rules, the contributions weighting kernel is used to assign 12.5% contributions from the North, South, East and West side non-Pentile RGBW structures (D1-D4) and to assign 50% contribution from the central non-Pentile RGBW structure (D0) so as to thereby determine the drive signal to be applied to the corresponding Pentile dot pixel (either an RG dot pixel or a BW dot pixel).

If a location of the central (D0) red, green, blue and white data Ro, Go, Bo and Wo resampled using the adjacent dot data D1, D2, D3 and D4 corresponds to even numbered dots of the display panel 200, the red, green, blue and white data Ro, Go, Bo and Wo are reconstructed to generate red and green data Rr and Gr. If the location of the central (D0) red, green, blue and white data Ro, Go, Bo and Wo resampled using the adjacent dot data D1, D2, D3 and D4 corresponds to odd numbered dots of the display panel 200, the red, green, blue and white data Ro, Go, Bo and Wo are reconstructed to generate blue and white data Br and Wr.

Figure 5:
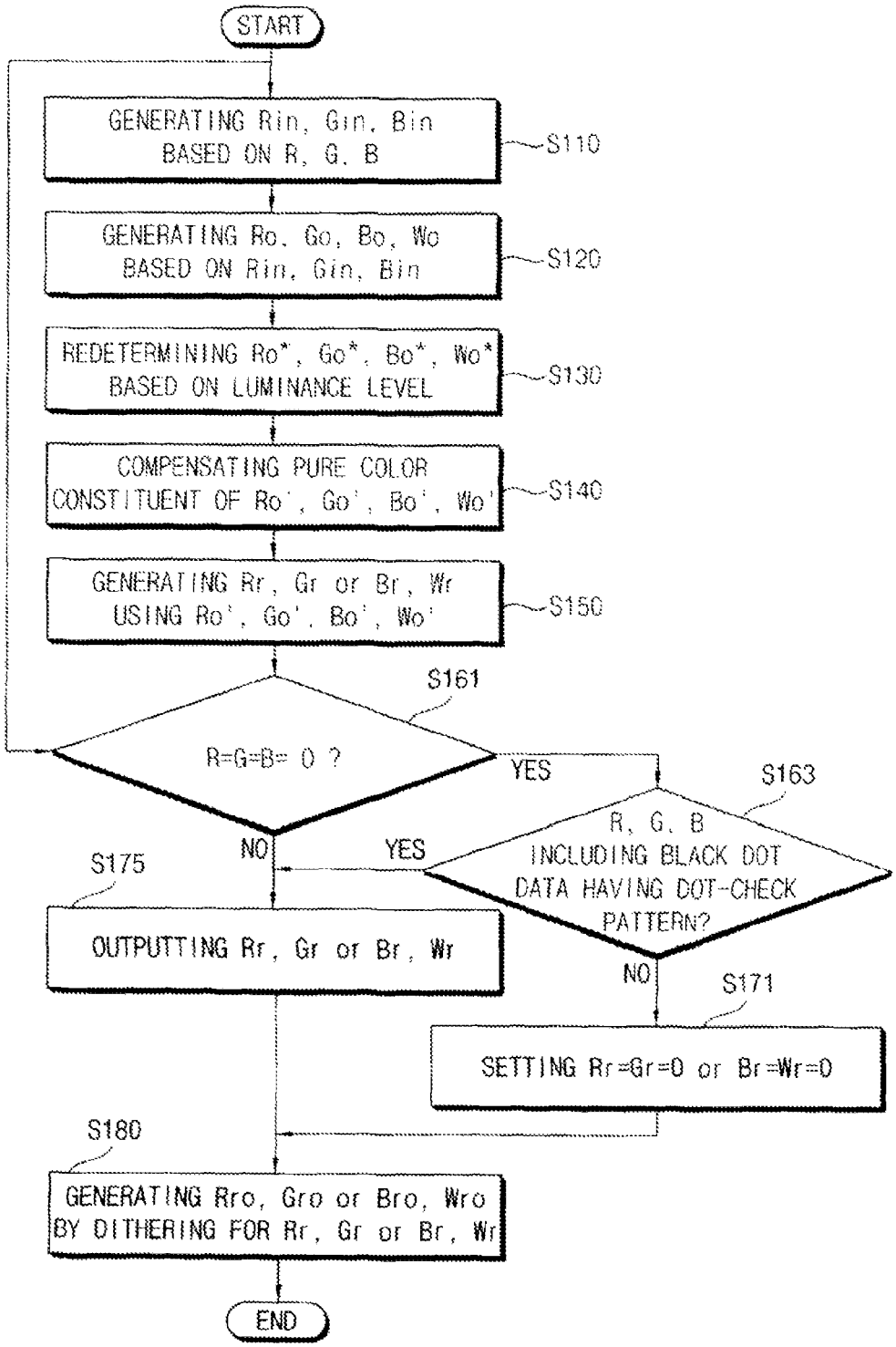
FIG. 5 is a flowchart illustrating a method of processing data by the data processing circuit of FIG. 2.
Figure 6A:
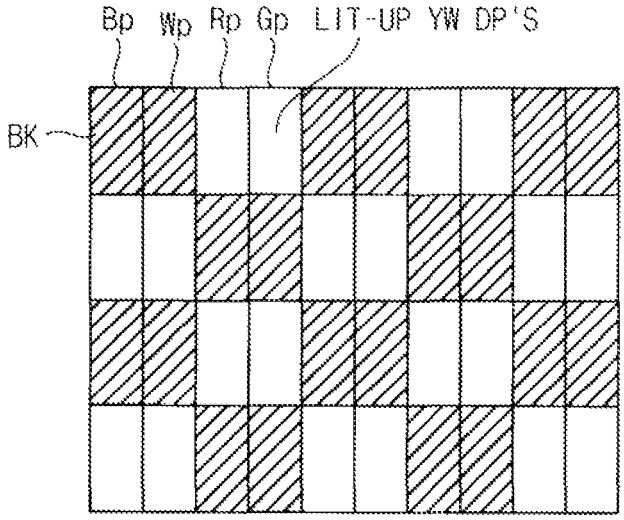
FIGS. 6A and 6B are conceptual diagrams illustrating a dot-check patterned artifact.
Figure 6B:
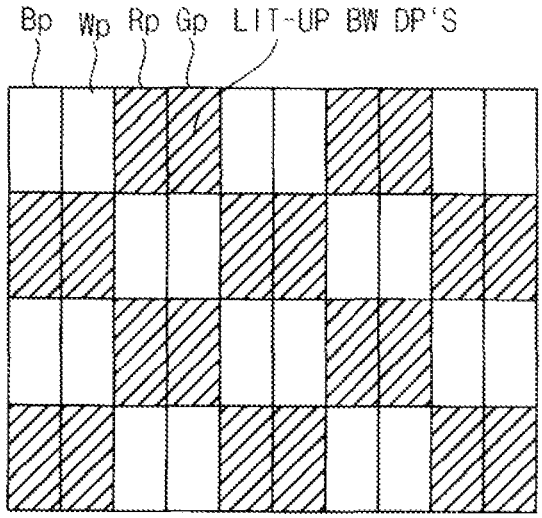

FIG. 5 is a flowchart diagram illustrating a method of processing data signals of the data processing circuit of FIG. 2. FIGS. 6A and 6B are conceptual diagrams illustrating possible dot-check patterned artifacts.

Referring to FIGS. 3 and 5, the input gamma generator 110 generates m-bit wide, linearized red, green and blue value encoded data signals: Rin, Gin and Bin based on n-bit wide, nonlinearized red, green and blue value encoded data signals R, G and B (step S110). The number of bits per subpixel in the m-bit red, green and blue data Rin, Gin and Bin is greater than that of the n-bit red, green and blue data R, G and B. The second line memory buffer 171 stores the n-bit wide red, green and blue value encoded data signals R, G and B.

The gamut mapping part 120 generates m-bit red, green, blue and white data Ro, Go, Bo and Wo based on the m-bit red, green and blue data Rin, Gin and Bin (step S120).

The luminance controller 130 determines a luminance level of the light source part 500 using a histogram based on the m-bit red, green, blue and white data Ro, Go, Bo and Wo corresponding to a frame.

The scaler 140 redetermines grayscale levels of its respectively output m-bit red, green, blue and white data signals, Ro*, Go*, Bo* and Wo* based on the luminance level (step S130).

The clamping part 150 compensates the pure color element of its respectively output m-bit red, green, blue and white data signals, Ro', Go', Bo' and Wo' according to the luminance level of the light source part 500 (step S140).

The subpixel rendering part 160 generates the m-bit red and green data Rr and Gr or the m-bit blue and white data Br and Wr using the red, green, blue and white data Ro', Go', Bo' and Wo' and the adjacent data adjacent to the red, green, blue and white data Ro, Go, Bo and Wo stored in the first line memory buffer 165 according to an RGBW structure of the display panel 200 (step S150).

The black setting part 175 determines whether all grayscale levels of the n-bit red, green and blue data R, G and B stored in the second line memory buffer 171 are substantially equal to "0" which represents the predetermined black grayscale level in one embodiment, (step S161). If all grayscale levels of the n-bit red, green and blue data R, G and B are substantially equal to "0", the black setting part 175 determines whether the n-bit red, green and blue data R, G and B include black dot data having a predetermined dot-check pattern (step S163).

If the n-bit red, green and blue data R, G and B do not include the black dot data having the predetermined dot-check pattern, the black setting part 175 sets the m-bit red and green data Rr and Gr to "0" (the YW Dp equal to 0) or the m-bit blue and white data Br and Wr to "0" (the BW Dp equal to 0) to thereby represent the corresponding black grayscale level (step S171).

On the other hand, if at least one of the grayscale levels of the red, green and blue data R, G and B is not equal to "0" in the step S161, the black setting part 175 outputs the m-bit red and green data Rr and Gr or the m-bit blue and white data Br and Wr generated in the subpixel rendering part 160 as they are (as is), without any alteration (step S175).

In addition, if the n-bit red, green and blue data R, G and B include the black dot data having the predetermined dot-check pattern in the step S163, the black setting part 175 outputs the m-bit red and green data Rr and Gr or the m-bit blue and white data Br and Wr generated in the subpixel rendering part 160 as they are (as is), without any alteration (step S175).

Referring to FIG. 6A, shown is a first predetermined pattern which can be simply referred to as Checkerboard-wise Lit-up YW Dp's (turned on yellowish-white dot pixels). In the Checkerboard-wise Lit-up YW Dp's pattern, the BW Dp's (blueish-white dot pixels) are turned off and thus display a black pattern portion BK of the Checkerboard pattern. On the other hand, the red and green subpixels Rp and Gp are lit up so as to display the white portion of the Checkerboard pattern as turned on YW Dp's (which display yellow instead of white).

Referring next to FIG. 6B, shown is a second predetermined pattern which can be simply referred to as Checkerboard-wise Lit-up BW Dp's (turned on blueish-white dot pixels). In this second pattern, the red and green subpixels Rp and Gp display the black pattern BK portion of the Checkerboard pattern. The Lit-up BW Dp's have a relatively lower luminance than an ideal WW Dp (white-white dot pixel, not shown) and thus, the intended 50% black and 50% white texture may not be clearly displayed. Similarly, in the case of FIG. 6A, the YW Dp's (which display yellow instead of white) have a slightly different luminosity effect than the ideal WW Dp (white-white dot pixel, not shown) and thus, the intended 50% black and 50% white texture may not be clearly displayed.

In accordance with the present disclosure, a test is automatically carried out for detecting either one of the first and second patterns of respective FIGS. 6A and 6B. When either the Checkerboard-wise Lit-up YW Dp's pattern is detected (FIG. 6A) or the Checkerboard-wise Lit-up BW Dp's pattern is detected (FIG. 6B) and a Black Re-establishing operation is indicated to be possible by the black setting part 175, the Black Re-establishing operation is automatically suppressed and instead, the m-bit red and green data Rr and Gr or the m-bit blue and white data Br and Wr outputted from the subpixel rendering part 160 are displayed as they are, without any alteration.

The dithering part 180 performs dithering for the m-bit red and green data Rr and Gr or the m-bit blue and white data Br and Wr to generate the n-bit red and green data Rro and Gro or the blue and white data Bro and Wro (step S180).

Figure 7A:
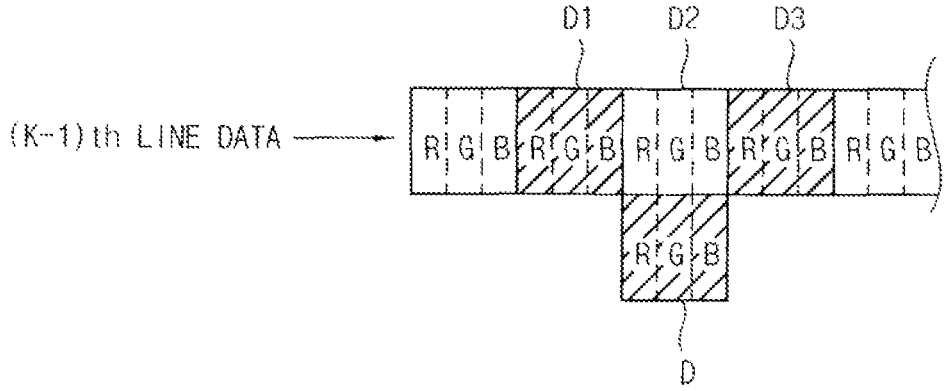
FIGS. 7A and 7B are conceptual diagrams illustrating a method of determining the dot-check patterned artifact of FIGS. 6A and 6B.
Figure 7B:
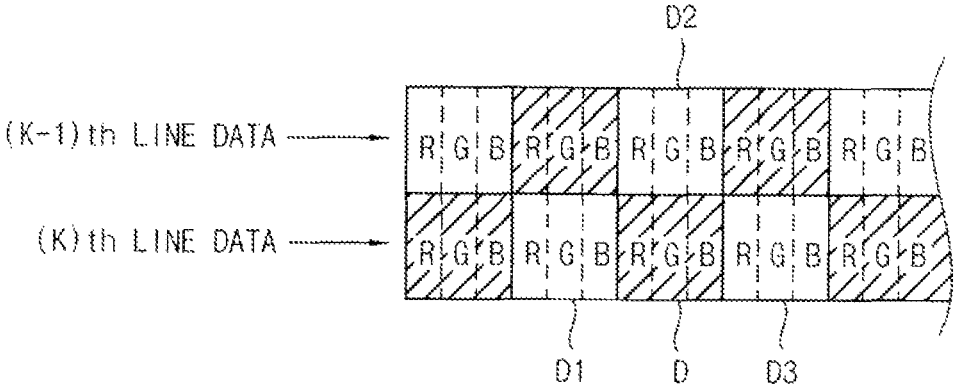

FIGS. 7A and 7B are conceptual diagrams illustrating a method of automatically determining whether the dot-check patterned artifacts of FIG. 6A or 6B are present.

Referring to FIGS. 3, 5 and 7A, the second line memory buffer 171 may be a single line memory buffer. The second line memory buffer 171 is storing red, green and blue data R, G and B corresponding to a (k−1)-th horizontal line (the previous row) when the black setting part 175 receives data corresponding to the k-th horizontal line. Herein, k is a natural number.

The black setting part 175 automatically determines that the dot-check patterned artifacts of FIG. 6A or 6B will be generated based on the dot data D stored in the second line memory buffer 171 and adjacent data such as a first dot data D1, a second dot data D2 and a third dot data D3 disposed adjacent to the dot data D, when grayscale levels of the red and green data Rr and Gr corresponding to the dot data D are substantially equal to "0" which represents the black grayscale level and thus indicates that the black re-establishing part 175 will be trying to re-establish a more pure black downstream in the pipeline.

For example, when all of the first dot data D1 and the third dot data D3 disposed in a diagonal direction forming a check pattern with respect to the dot data D are substantially equal to "0" and the second dot data D2 are not equal to "0," the black setting part 175 determines the dot data D as the black dot data having the dot-check pattern. Accordingly, the black setting part 175 performs the step S175.

In contrast, when the first dot data D1 and the third dot data D3 are not equal to "0" and the second dot data D2 are substantially equal to "0," the black setting part 175 determines the dot data D not to be the black dot data having the dot-check pattern. Accordingly the black setting part 175 performs the step S171.

Referring to FIGS. 3, 5 and 7B, the second line memory buffer 171 including a double line memory buffer is explained. The second line memory buffer 171 stores red, green and blue data R, G and B corresponding to a (k−1)-th horizontal line and a k-th horizontal line, when the black setting part 175 receives data corresponding to the k-th horizontal line.

The black setting part 175 determines a dot-check pattern based on the dot data D stored in the second line memory buffer 171 and adjacent data such as a first dot data D1, a second dot data D2 and a third dot data D3 disposed adjacent to the dot data D, when grayscale levels of the red and green data Rr and Gr corresponding to the dot data D are substantially equal to "0" which represents the black grayscale level.

For example, when at least one of the first, second and the third dot data D1, D2 and D3 is substantially equal to "0" which represents the black grayscale level, the black setting part 175 determines the dot data D not to be the black dot data having the dot-check pattern. Accordingly, the black setting part 175 performs the step S171.

In contrast, when all of the first, second and third dot data D1, D2 and D3 are not equal to "0," the black setting part 175 determines the dot data D as the black dot data having the dot-check pattern. Accordingly the black setting part 175 performs the step S175.

Figure 1B:
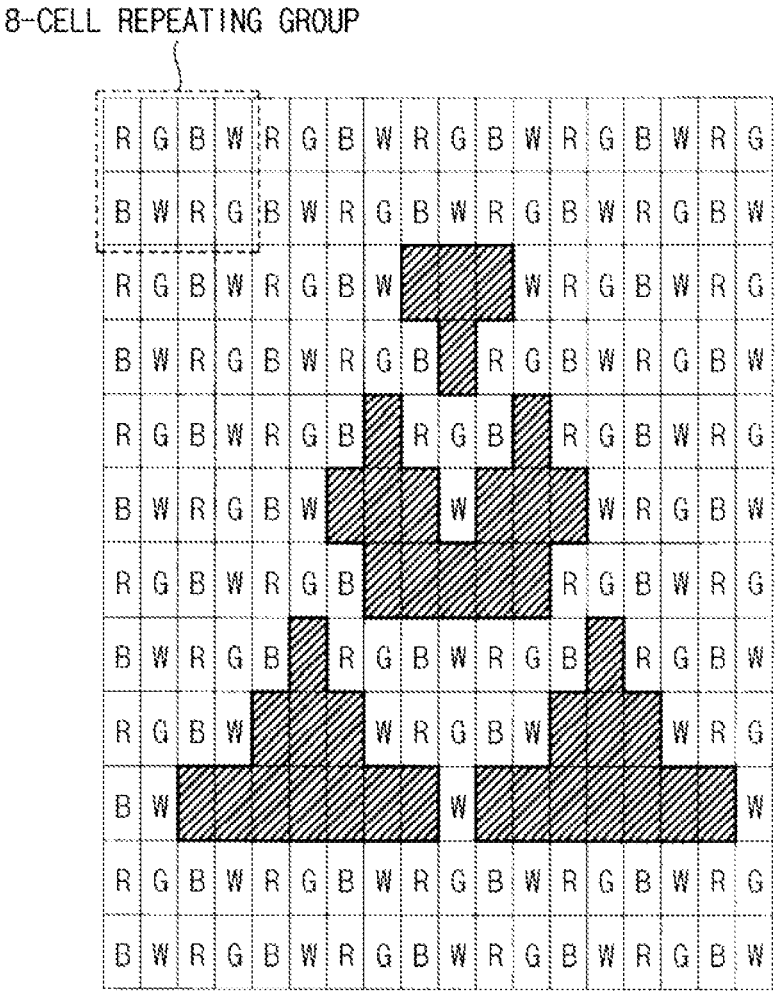
Figure 8A:
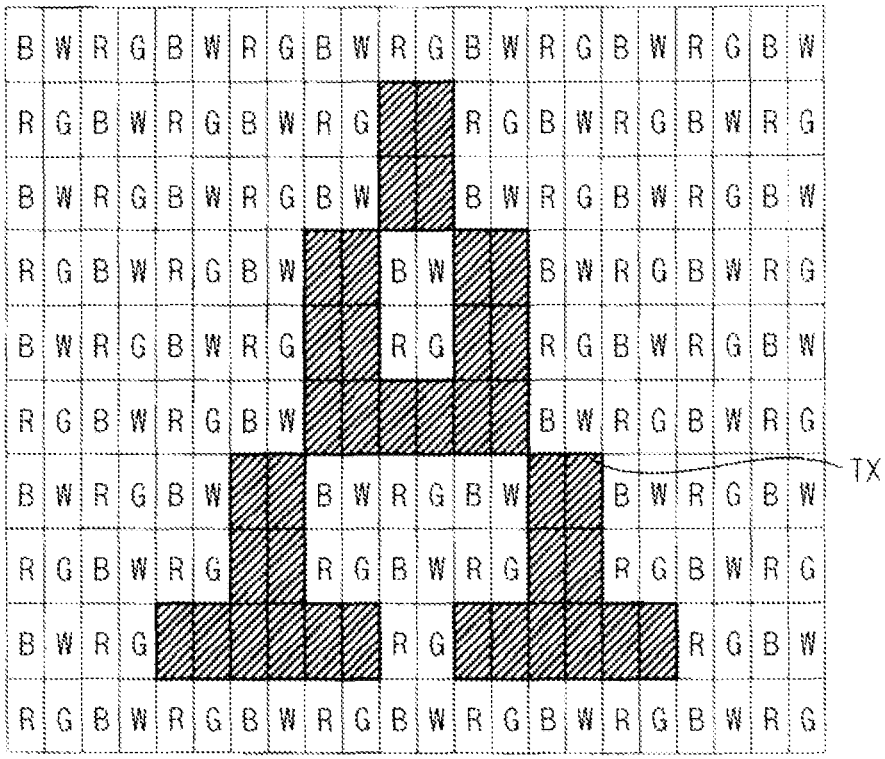
FIGS. 8A to 8C are conceptual diagrams illustrating various patterns displayed on the display apparatus of FIG. 2.
Figure 8B:
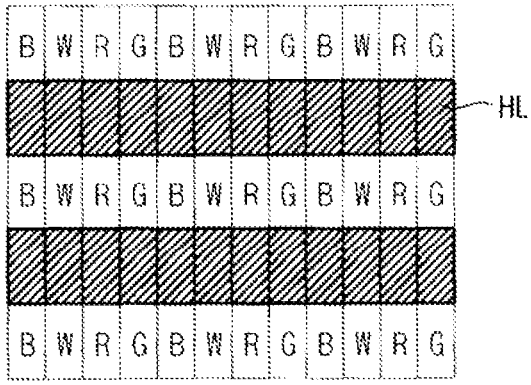
Figure 8C:
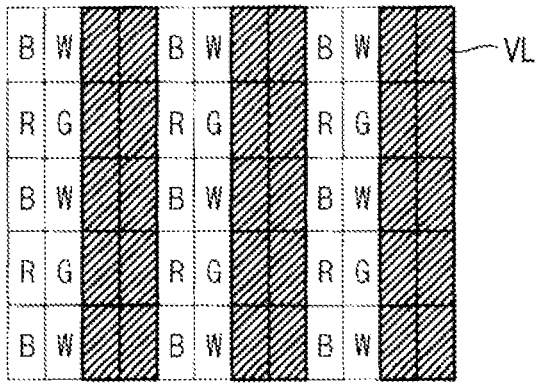

FIGS. 8A to 8C are conceptual diagrams illustrating examples of various patterns displayed on the Pentile RGBW display apparatus of FIG. 2 when the checkerboard testing algorithm of the present disclosure is used. FIG. 8A is a conceptual diagram illustrating a black text displayed on the display apparatus of FIG. 2 except this time, unlike FIG. 1B, the interior white area below the apex of the "A" consists of a lit-up BW Dp in a first row and a lit-up YW Dp in the row below it where each of the lit up Dp's forms part of a respective checkerboard pattern at least in the horizontal row direction.

FIG. 8B is a conceptual diagram illustrating a horizontal white stripes pattern displayed on the display apparatus of FIG. 2 that preserves white color balance. FIG. 8C is a conceptual diagram illustrating a vertical white stripes pattern displayed on the display apparatus of FIG. 2 that also preserves white color balance.

Referring to the specifics of FIG. 8A, due to the nature of the 8-cell repeating group. the red and green subpixels R and G (also known herein as the YW Dp's) are repeatedly arranged in a zig-zag shape and the blue and white subpixels B and W (also known herein as the BW Dp's) are also repeatedly arranged in a zig-zag shape in a region adjacent to the black text TX. Each white subpixel W may alone display as a white dot region. Also, every triad of adjacent red, green, and blue subpixels R, G and B, in combination, may display as a white region. In addition, each YW Dp in combination with an adjacent BW Dp may be both lit up to thereby display as a white region. By using variations of these techniques, a desired shape of a black filled glyph (e.g., a text glyph, TX) may be displayed with a desired shape on a white background without distortion.

Referring to FIG. 8B, this shows the RGB triad approach wherein red, green, blue and white subpixels R, G, B and W are repeatedly arranged in a horizontal direction and lit up as such, so that a horizontal stripe pattern adjacent to a black horizontal line HL is displayed with white. Therefore, the horizontal black line pattern may easily be displayed without distortion.

Referring to FIG. 8C, this shows the BW+YW=WW approach wherein a two-subpixel wide white vertical line may be formed. In other words, red, green, blue and white subpixels R, G, B and W are repeatedly arranged in the vertical direction, so that a vertical stripe pattern adjacent to a black vertical line VL is displayed with white. Therefore, the vertical black line pattern may be easily displayed without distortion. Review of FIG. 8A will show that the black "A" glyph is formed of a combination black horizontal and vertical lines where the black lines are bounded on left and right sides thereof by lit-up combinations of BW+YW=WW dot pixels.

Accordingly, expression of sharp edged glyphs such as alphabetic characters may be improved on an RGBW Pentile organized display screen.

Hereinafter, the same reference numerals will be used to refer to the same or like parts as those described in above example embodiment, and any repetitive detailed explanation will be omitted or briefly explained.

Figure 9:
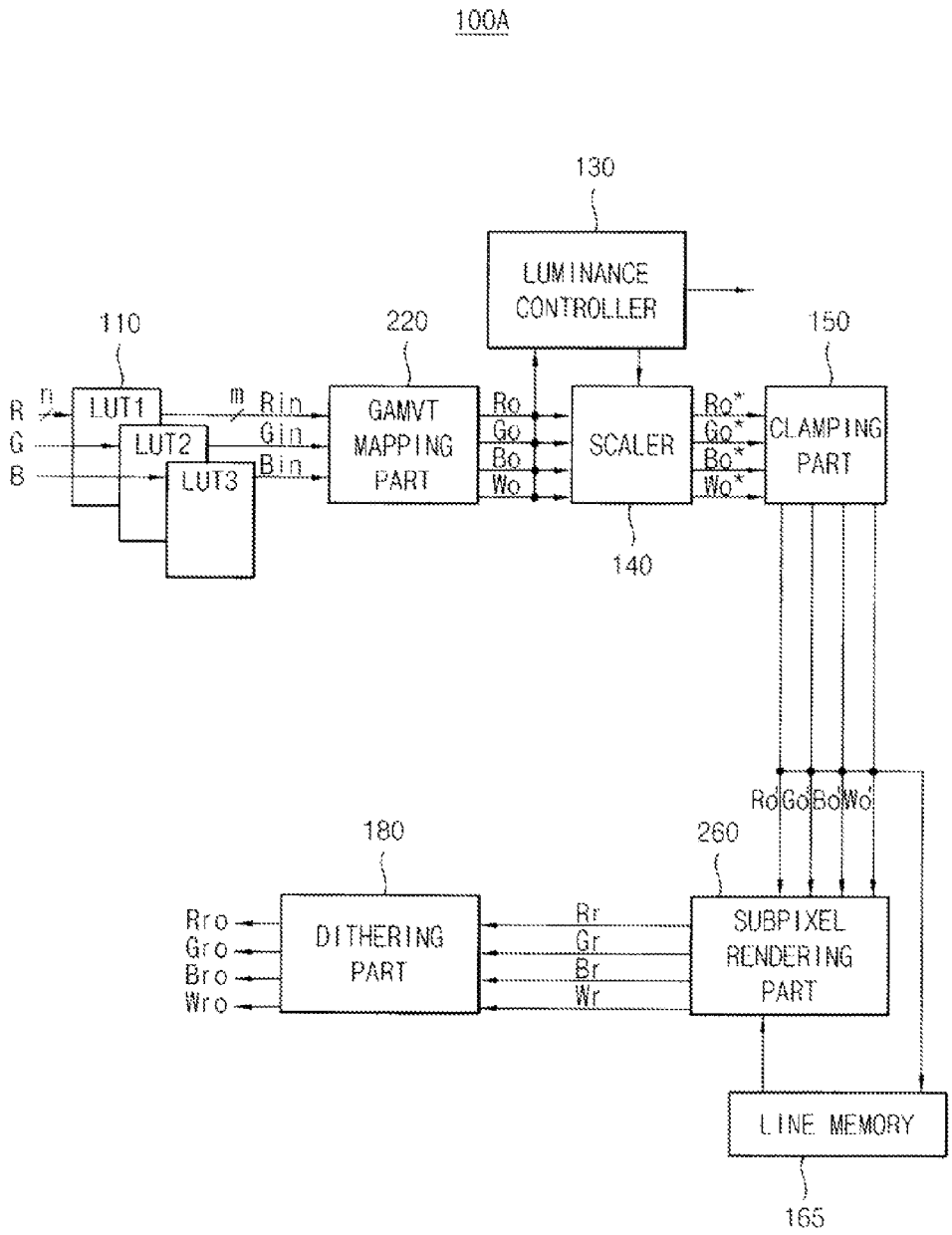
FIG. 9 is a block diagram illustrating a data processing circuit according to another example embodiment in accordance with the disclosure.

FIG. 9 is a block diagram illustrating a second data processing circuit according to another example embodiment of the present disclosure.

Referring to FIGS. 2 and 9, the illustrated data processing circuit 100A includes an input gamma generator 110, a gamut mapping part 220, a luminance controller 130, a scaler 140, a clamping part 150, a subpixel rendering part 260, a line memory buffer 165 and a dithering part 180. In this case, there is no discrete black setting part 175 or second line buffer 171.

The input gamma generator 110 includes a red lookup table LUT1, a green lookup table LUT2 and a blue lookup table LUT3. The input gamma generator 110 outputs m-bit red data Rin, m-bit green data Gin and m-bit blue data Bin based on the n-bit red data R, n-bit green data G and n-bit blue data B using the red, green and blue lookup tables LUT1, LUT2 and LUT3. The n and m are natural numbers and n<m.

The gamut mapping part 220 is different from 120 of FIG. 3. The different gamut mapping part 220 generates m-bit red, green, blue and white data Ro, Go, Bo and Wo based on the m-bit red, green and blue data Rin, Gin and Bin according to the above Equations 1 and 2 with a slight modification such that its solutions can include all black sections. For example, if all of grayscale levels of the red, green and blue data Rin, Gin and Bin are substantially equal to "0" (near zero in accordance with a predetermined nearness threshold) which represents a black grayscale level, the gamut mapping part 220 sets grayscale levels of the m-bit red, green, blue and white data Ro, Go, Bo, Wo corresponding to the red, green and blue data Rin, Gin and Bin to a black grayscale level. In contrast, if grayscales of the red, green and blue data Rin, Gin and Bin are not substantially equal to "0" (spaced apart from zero by more than the predetermined nearness threshold), the gamut mapping part 220 generates the m-bit red, green, blue and white data Ro, Go, Bo and Wo according to Equations 1 and 2.

The luminance controller 130 determines a luminance level of the light source part 500 using a histogram based on the red, green, blue and white data Ro, Go, Bo and Wo generated in the gamut mapping part 220.

The scaler 140 redetermines grayscale levels of the red, green, blue and white data Ro*, Go*, Bo* and Wo* generated in the gamut mapping part 220 based on the luminance level determined in the luminance control part 130.

The clamping part 150 compensates the red, green, blue and white data Ro*, Go*, Bo* and Wo* determined in the scaler 140 so that the clamping part 150 compensates a pure color element sacrificed when the light source part 500 is driven with the low luminance level by the luminance controller 130.

The line memory buffer 165 stores data outputted from the clamping part 150. For example, the line memory buffer 165 may store adjacent data adjacent to the red, green, blue and white data Ro', Go', Bo' and Wo'.

The subpixel rendering part 260 reconstructs the red, green, blue and white data Ro', Go', Bo' and Wo' to generate subpixel rendered red and green data Rr and Gr or blue and white data Br and Wr using the subpixel rendering algorithm explained above with reference for example to FIGS. 4A and 4B.

For example, if the grayscale levels of the red, green, blue and white data Ro, Go, Bo and Wo include a black grayscale level, the subpixel rendering part 260 determines whether the red, green, blue and white data Ro, Go, Bo and Wo are black dot data having a dot-check pattern using adjacent data adjacent to the red, green, blue and white data Ro, Go, Bo and Wo. If the red, green, blue and white data Ro, Go, Bo and Wo are not the black dot data having the dot-check pattern, the subpixel rendering part 260 sets grayscale levels of the red and green data Rr and Gr or the blue and white data Br and Wr corresponding to the red, green, blue and white data Ro, Go, Bo, Wo to a black grayscale level. In contrast, if the red, green, blue and white data Ro, Go, Bo and Wo are the black dot data having the dot-check pattern, the subpixel rendering part 260 reconstructs the red, green, blue and white data Ro, Go, Bo and Wo to generate the red and green data Rr and Gr or the blue and white data Br and Wr using the subpixel rendering algorithm explained above with reference to FIGS. 4A and 4B.

The dithering part 180 performs dithering for the red and green data Rr and Gr or the blue and white data Br and Wr which are processed to an m-bit type, and thus outputs n-bit red and green data Rro and Gro or n-bit blue and white data Bro and Wro.

Figure 10:
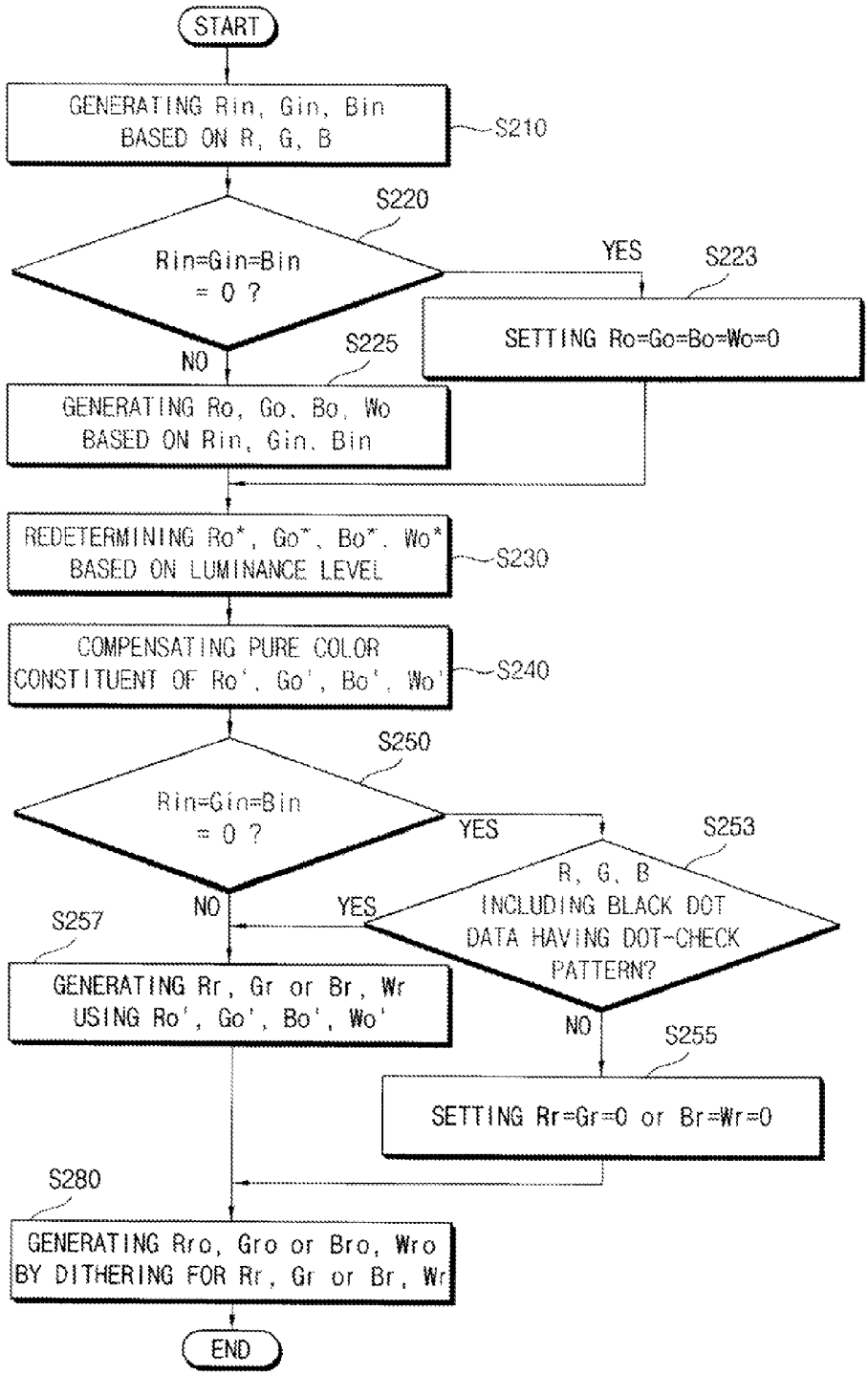
FIG. 10 is a flowchart illustrating a method of processing data by a data processing circuit of FIG. 9.

FIG. 10 is a flowchart diagram illustrating a method of processing data signals of the second data processing circuit of FIG. 9.

Referring to FIGS. 9 and 10, the input gamma generator 110 generates m-bit red, green and blue data Rin, Gin and Bin based on n-bit red, green and blue data R, G and B (step S210).

The gamut mapping part 220 determines whether all grayscale levels of the red, green and blue data Rin, Gin and Bin are equal to "0" which represents a black grayscale level (step S220). If all grayscale levels of the red, green and blue data Rin, Gin and Bin are substantially equal to "0," the gamut mapping part 220 sets grayscale levels of the m-bit red, green, blue and white data Ro, Go, Bo and Wo corresponding to the red, green and blue data Rin, Gin and Bin to "0" which represents a black grayscale level (step S223). In contrast, if the grayscale levels of the red, green and blue data Rin, Gin and Bin are not equal to "0," the gamut mapping part 220 generates the m-bit red, green, blue and white data Ro, Go, Bo and Wo according to Equations 1 and 2 (step S225).

The luminance controller 130 determines a luminance level of the light source part 500 using a histogram based on the m-bit red, green, blue and white data Ro, Go, Bo and Wo corresponding to a frame.

The scaler 140 redetermines grayscale levels of the m-bit red, green, blue and white data Ro*, Go*, Bo* and Wo* based on the luminance level (step S230).

The clamping part 150 compensates the pure color element of the m-bit red, green, blue and white data Ro', Go', Bo' and Wo' according to the luminance level of the light source part 500 (step S240).

The subpixel rendering part 260 includes a part that automatically bypasses subpixel rendering for dot check conditions. More specifically, the subpixel rendering part 260 determines whether all grayscale levels of the red, green, blue and white data Rin, Gin, Bin and Win are substantially equal to "0" which represents a black grayscale level (step S250). If all grayscale levels of the red, green, blue and white data Rin, Gin, Bin, and Win, are substantially equal to "0," the subpixel rendering part 260 determines whether the red, green, blue and white data Ro, Go, Bo and Wo are black dot data having a dot-check pattern using adjacent data adjacent to the red, green, blue and white data Ro, Go, Bo and Wo (step S253).

If the red, green, blue and white data Rin, Gin, Bin, and Win, are not the black dot data having the dot-check pattern, the subpixel rendering part 260 sets the grayscale levels of the red and green data Rr and Gr to "0" (thus forcing the corresponding YW Dp equal to zero) or sets the blue and white data Br and Wr corresponding to the red, green, blue and white data Rin, Gin, Bin and Win to "0" (thus forcing the corresponding BW Dp equal to zero) which represents the black grayscale level (step S255). Subpixel rendering step S257 is bypassed. In contrast, if the red, green, blue and white data Rin, Gin, Bin and Win are the black dot data but do not have the dot-check pattern, the subpixel rendering part 260 reconstructs the red, green, blue and white data Ro, Go, Bo and Wo using the normal subpixel rendering algorithm to thereby generate the red and green data Rr and Gr or the blue and white data Br and Wr using the subpixel rendering algorithm explained above with reference for example to FIGS. 4A and 4B (step S257).

The dithering part 180 performs dithering for the m-bit red and green data Rr and Gr or the m-bit blue and white data Br and Wr provided from the subpixel rendering part 260 to generate n-bit red and green data Rro and Gro or n-bit blue and white data Bro and Wro (step S280).

In the present example embodiment, the data outputted from the clamping part 150 and stored in the line memory buffer 165 are used to determine whether the red, green, blue and white data Ro, Go, Bo and Wo are the black dot data having the dot-check pattern. Although not shown in figures, an additional line memory buffer storing data outputted from the subpixel rendering part 260 may be used to determine whether the red, green, blue and white data Rin, Gin, Bin, and Win, are the black dot data having the dot-check pattern. In this case, the additional line memory buffer storing the data from the subpixel rendering part 260 may be a single line memory buffer or a double line memory buffer as explained above with reference to FIGS. 7A and 7B.

According to the second example embodiment, the black text, the black horizontal pattern and the black vertical pattern displayed on the display apparatus may be displayed without distortion as shown in FIGS. 8A, 8B and 8C. In addition, the function of the gamut mapping part 220 and the subpixel rendering part 260 may be modified to decrease the number of memories.

Figure 11:
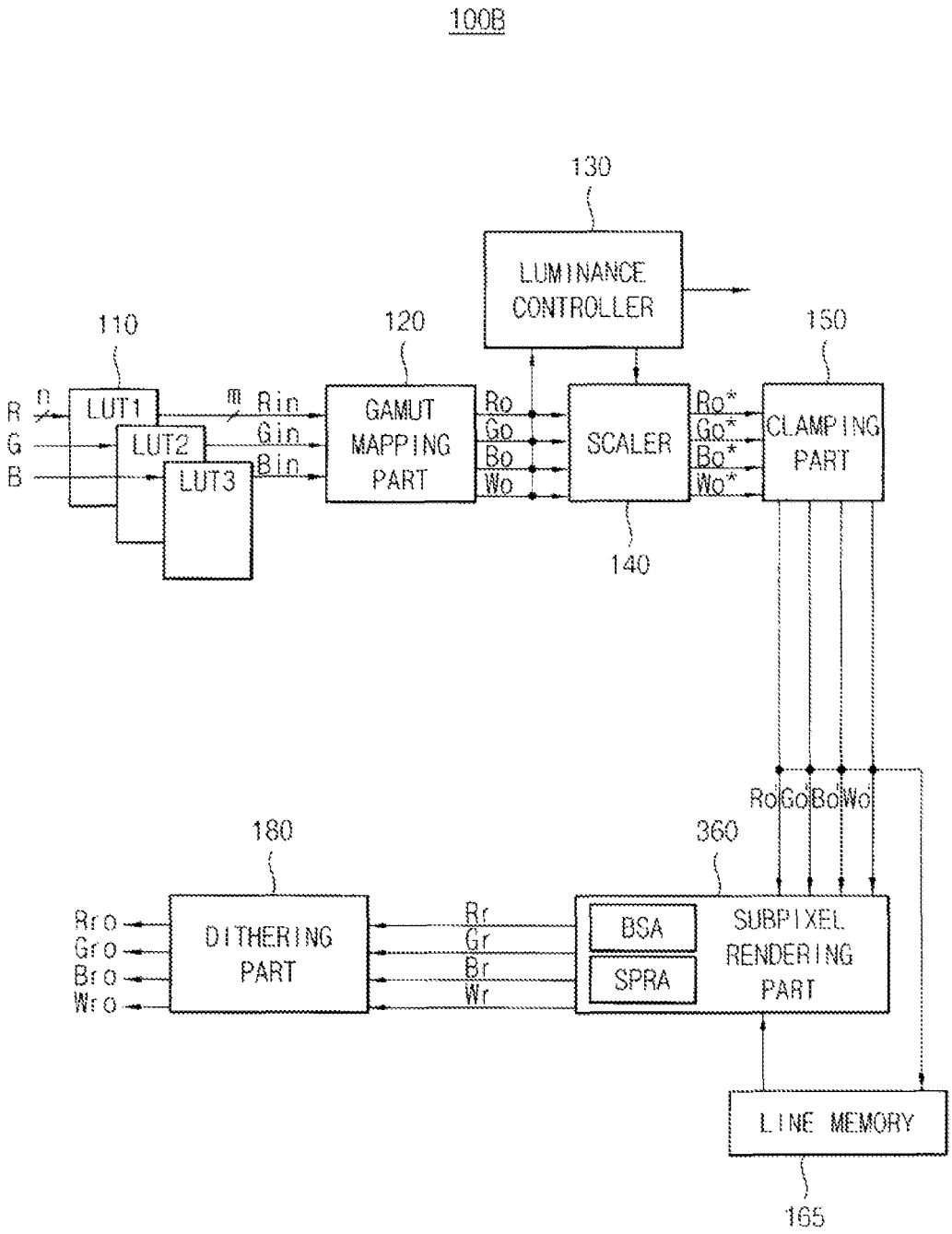
FIG. 11 is a block diagram illustrating a data processing circuit according to still another example embodiment in accordance with the disclosure.

FIG. 11 is a block diagram illustrating a third data processing circuit according to still another example embodiment of the present disclosure.

Referring to FIG. 11, the data processing circuit 100B includes an input gamma generator 110, a gamut mapping part 120, a luminance controller 130, a scaler 140, a clamping part 150, a subpixel rendering part 360, a line memory buffer 165 and a dithering part 180.

The input gamma generator 110 includes a red lookup table LUT1, a green lookup table LUT2 and a blue lookup table LUT3. The input gamma generator 110 outputs m-bit red data Rin, m-bit green data Gin and m-bit blue data Bin based on the n-bit red data R, n-bit green data G and n-bit blue data B using the red, green and blue lookup tables LUT1, LUT2 and LUT3. The n and m are natural numbers and n<m.

The gamut mapping part 120 generates m-bit red, green, blue and white data Ro, Go, Bo and Wo based on the m-bit red, green and blue data Rin, Gin and Bin according to Equations 1 and 2.

The luminance controller 130 determines a luminance level of the light source part 500 using a histogram based on the red, green, blue and white data Ro, Go, Bo and Wo generated in the gamut mapping part 120.

The scaler 140 redetermines grayscale levels of the red, green, blue and white data Ro, Go, Bo and Wo generated in the gamut mapping part 120 based on the luminance level determined in the luminance control part 130.

The clamping part 150 compensates the red, green, blue and white data Ro*, Go*, Bo* and Wo* determined in the scaler 140 so that the clamping part 150 compensates a pure color element sacrificed when the light source part 500 is driven with the low luminance level by the luminance controller 130.

The line memory buffer 165 stores data outputted from the clamping part 150. For example, the line memory buffer 165 may store adjacent data adjacent to the red, green, blue and white data Ro', Go', Bo' and Wo'.

The subpixel rendering part 360 includes a blue timing shift algorithm module (BSA) and a subpixel rendering algorithm module (SPRA) explained above with reference to FIGS. 4A and 4B. The BSA module operates to generate smoother images near edges of the screen when processing natural image color combinations and displaying various nonartificial color images. Although the BSA smoothly processes the color combination in a natural colorful display, the BSA can generate an artifact in a sharp edged glyph (e.g., text) editing display including black and white colors.

The subpixel rendering part 360 according to the present example embodiment automatically tests different regions of the display image to thereby determine whether a display region is a text display region or a natural color mix display region by applying a 3 by 3 data determining block to the red, green, blue and white data Ro', Go', Bo' and Wo' outputted from the clamping part 150 and the adjacent data stored in the line memory buffer 165. If a grayscale level of a dot data to which the 3 by 3 data determining block is applied is "0" which represents a black grayscale and/or "255" which represents a white grayscale in an 8-bit system, the sub pixel rendering part 360 determines the display region as being the text display region so that the sub pixel rendering part 360 only applies the SPRA instead of applying both of the BSA and the SPRA. In contrast, if the grayscale level of the dot data to which the 3 by 3 data determining block is applied includes a grayscale level except for the black and white grayscale levels, the sub pixel rendering part 360 determines the display region as being the natural color display region so that the sub pixel rendering part 360 applies both of the BSA and the SPRA.

The dithering part 180 performs dithering for the red and green data Rr and Gr or the blue and white data Br and Wr which are processed to the m-bit type, and outputs n-bit red and green data Rro and Gro or n-bit blue and white data Bro and Wro.

Figure 12:
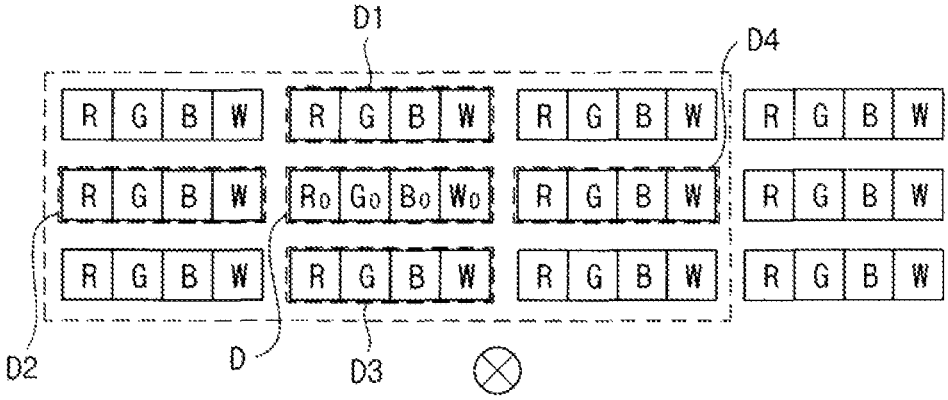
FIG. 12 is a conceptual diagram illustrating operation of a subpixel rendering part of FIG. 11.

FIG. 12 is a conceptual diagram illustrating operation of the subpixel rendering part of FIG. 11.

Referring to FIGS. 11 and 12, the subpixel rendering part 360 determines whether the dot data D are data in a text display region or in a color display region by applying a 3 by 3 data determining block to the dot data D including the red, green, blue and white data Ro, Go, Bo and Wo outputted from the clamping part 150 and adjacent dot data stored in the line memory buffer 165.

For example, the adjacent dot data include first dot data D1 disposed adjacent to the dot data D in a first direction, second dot data D2 disposed adjacent to the dot data D in a second direction, third dot data D3 disposed adjacent to the dot data D in a third direction and fourth dot data D4 disposed adjacent to the dot data D in a fourth direction.

The 3 by 3 determining block applies a weight of "1" to central dot data and four adjacent dot data to upper, lower, left and right directions from the central dot data, and "0" to four adjacent dot data to diagonal directions from the central dot data. For example, the 3 by 3 determining block applies "1" to the dot data D and the first, second, third and fourth dot data D1, D2, D3 and D4.

The maximum grayscale values and the minimum grayscale values of the dot data D and the first, second, third and fourth dot data D1, D2, D3 and D4 are respectively calculated by Equation 3.

$$MAX=MAXIMUM(Rg,Gg,Bg,Wg),$$

$$MIN=MINIMUM(Rg,Gg,Bg,Wg) \quad \text{[Equation 3]}$$

Herein, Rg is a grayscale level of red data, Gg is a grayscale level of green data, Bg is a grayscale level of blue data, and Wg is a grayscale level of white data.

If the maximum grayscale values and the minimum grayscale values are "0" or "255" in an 8-bit system, or "0" and "255," the subpixel rendering part 360 determines the dot data D as the data in the text display region. If the dot data D are determined as the data in the text display region, the sub pixel rendering part 360 only applies just the SPRA instead of applying both of the BSA and the SPRA.

In addition, if the maximum grayscale values and the minimum grayscale values include the grayscale level except for "0" and "255," the subpixel rendering part 360 determines the dot data D as the data in the color display region. If the dot data D are determined as the data in the color display region, the sub pixel rendering part 360 applies both of the BSA and the SPRA.

Figure 13:
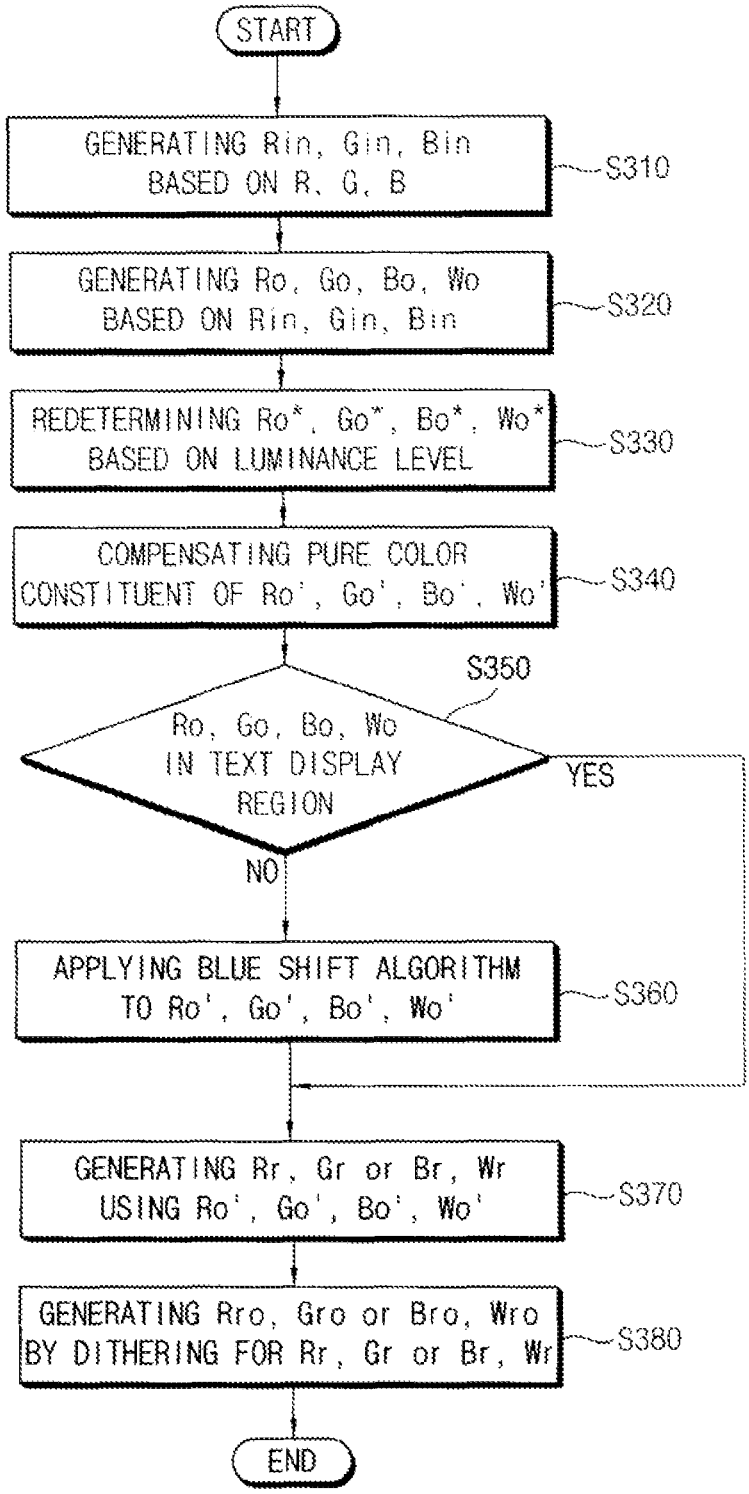
FIG. 13 is a flowchart diagram illustrating a method of processing data by the data processing circuit of FIG. 11.

FIG. 13 is a flowchart diagram illustrating a method of processing data of the data processing circuit of FIG. 11.

Referring to FIGS. 11, 12 and 13, the input gamma generator 110 generates m-bit red, green and blue data Rin, Gin and Bin based on n-bit red, green and blue data R, G and B (step S310).

The gamut mapping part 120 generates m-bit red, green, blue and white data Ro, Go, Bo and Wo based on the m-bit red, green and blue data Rin, Gin and Bin (step S320).

The luminance controller 130 determines a luminance level of the light source part 500 using a histogram based on the m-bit red, green, blue and white data Ro, Go, Bo and Wo corresponding to a frame.

The scaler 140 redetermines grayscale levels of the m-bit red, green, blue and white data Ro*, Go*, Bo* and Wo* based on the luminance level (step S330).

The clamping part 150 compensates the pure color element of the m-bit red, green, blue and white data Ro', Go', Bo' and Wo' according to the luminance level of the light source part 500 (step S340).

The subpixel rendering part 360 determines whether the red, green, blue and white data Ro', Go', Bo' and Wo' are data in a text display region by applying the 3 by 3 data determining block to the red, green, blue and white data Ro', Go', Bo' and Wo' and the data stored in the line memory buffer 165 (step S350).

As shown in FIG. 12, if the grayscale level of the five dot data to which the 3 by 3 data determining block is applied includes a grayscale level except for "0" which represents the black grayscale level and "255" which represents the white grayscale level in an 8-bit system, the sub pixel rendering part 360 applies the BSA to the red, green, blue and white data Ro', Go', Bo' and Wo' (step S360). The subpixel rendering part 360 reconstructs the red, green, blue and white data Ro', Go', Bo' and Wo' to generate red and green data Rr and Gr or blue and white data Br and Wr using the SPRA explained above with reference to FIGS. 4A and 4B (step S370).

In contrast, if the grayscale level of the five dot data to which the 3 by 3 data determining block is applied is substantially equal to "0" which represents the black grayscale level and/or "255" which represents the white grayscale level in an 8-bit system, the subpixel rendering part 360 reconstructs the red, green, blue and white data Ro, Go, Bo and Wo to generate red and green data Rr and Gr (a YW Dp) or blue and white data Br and Wr (a BW Dp) using the SPRA (step S370) instead of using both of the SPRA and the BSA. In the present example embodiment, although the BSA is applied prior to the SPRA, the SPRA may be applied prior to the BSA.

The dithering part 180 performs dithering for the m-bit red and green data Rr and Gr or the m-bit blue and white data Br and Wr to output the n-bit red and green data Rro and Gro or the blue and white data Bro and Wro (step S380).

According to the present example embodiment, the black text, the black horizontal pattern and the black vertical pattern may be displayed without distortion as shown in FIGS. 8A, 8B and 8C. In addition, the subpixel rendering part 360 is modified, so that the number of memories may be decreased and the operation of the method according to the present example embodiment may be simplified respectively comparing to the previous example embodiments of FIGS. 2 and 9.

As described above, according to the present disclosure of invention, a black text may be displayed without distortion by setting grayscale levels of red and green data (the YW dot pixels) or blue and white data (the BW dot pixels) corresponding to input red, green and blue data R, G and B including a black grayscale level to a black grayscale level. In addition, if the red, green, blue and white data Ro, Go, Bo and Wo are the data in a text display region, a blue shift algorithm may be selectively not applied so that a black text may be displayed without distortion.

The foregoing is illustrative of the present teachings and is not to be construed as limiting thereof. Although a few example embodiments of the present disclosure of invention have been described, those skilled in the art will readily appreciate from the foregoing that many modifications are possible in the example embodiments without materially departing from the novel teachings and advantages of the present disclosure. Accordingly, all such modifications are intended to be included within the scope of the present teachings. In the claims, means-plus-function clauses are intended to cover the structures described herein as performing the recited function and not only structural equivalents but also functionally equivalent structures. Therefore, it is to be understood that the foregoing is illustrative of the present teachings and is not to be construed as limited to the specific example embodiments disclosed, and that modifications to the disclosed example embodiments, as well as other example embodiments, are intended to be included within the scope of the teachings.

What is claimed is:

1. A display apparatus comprising:

a display panel having a display area substantially populated by a repeating group having a plurality of differently colored subpixels, the repeating group including white subpixels and the repeating group having a first subset of its subpixels defining a first class of off-white dot pixels and a second subset of its subpixels defining a second class of differently off-white dot pixels, where respective and immediately adjacent ones of dot pixels of the first and second off-white dot pixel subsets define a respective metameric set of dot pixels such that, when the subpixels of the metameric set are all lit, they create a perception of a white lit region on the display panel in the region of the lit-up metameric set of dot pixels and when all are un-lit, they create a perception of a corresponding black region on the display panel in the region of the un-lit metameric set of dot pixels;

a light source part configured to provide backlighting light to the display panel; and a data processing circuit that is configured to automatically force a first metameric set of dot pixels to a predetermined black grayscale level in response to automated detection of presence of a horizontal or vertical, near-black line being present in a supplied input signal defining a to be displayed image, the first metameric set of dot pixels including red and green subpixels or blue and white subpixels, the data processing circuit being configured to set the red and green subpixels or the blue and white subpixels to the predetermined black grayscale level based on red, green and blue data, and the data processing circuit comprising:

a gamut mapping part configured to map color components of the supplied input signal into a gamut space defined by the subpixels of said repeating group that substantially populates the display area of the display panel, the gamut mapping part being configured to map the red, green and blue data into red, green, blue and white data;

a subpixel rendering part configured to automatically reconstruct the gamut mapped color components for distributed reproduction by light outputting source points of the display area that is substantially populated by said repeating group, where the automatic reconstruction is based on an area resampling algorithm;

a first memory buffer configured to store the red, green and blue data before mapping into red, green, blue and white data; and a black re-establishing part configured to set the red and green subpixels or the blue and white subpixels to the predetermined black grayscale level based on red, green and blue data stored in the first memory buffer.

2. The display apparatus of claim 1, wherein the first memory buffer is configured to store a history of the supplied input signal that defines the to be displayed image; and the black re-establishing part is configured to automatically set to the predetermined black grayscale level an identified one or more metameric sets of dot pixels based on historic portions of the supplied input signal stored in the first memory buffer.

3. The display apparatus of claim 2, wherein the black re-establishing part is further configured to automatically bypass its operation of setting to the predetermined black grayscale level in response to detection of a predetermined checkerboard pattern.

4. The display apparatus of claim 1, wherein the data processing circuit further comprises a memory buffer configured to store data outputted from the gamut mapping part, and wherein the subpixel rendering part is configured to reconstruct the gamut mapped color components based on historic portions of the gamut mapped data stored in the memory buffer.

5. The display apparatus of claim 4, wherein the subpixel rendering part is configured to automatically bypass a black level forcing operation thereof in response to detection of a predetermined checkerboard pattern in the gamut mapped data stored in the memory buffer.

6. The display apparatus of claim 1, wherein the data processing circuit further comprises:

a luminance controller configured to determine a luminance level of a light source part using a histogram based on the gamut mapped color components; and a scaler configured to redetermine the gamut mapped color components based on the luminance level determined by the luminance controller.

7. The display apparatus of claim 1, wherein the line has a width equal to that of one of the off-white dot pixels.

* * * * *